US010444689B2

(12) United States Patent
Ogata

(10) Patent No.: US 10,444,689 B2
(45) Date of Patent: Oct. 15, 2019

(54) IMAGE FORMING APPARATUS AND LIFETIME JUDGMENT SYSTEM

(71) Applicant: KONICA MINOLTA, INC., Chiyoda-ku, Tokyo (JP)

(72) Inventor: Satoshi Ogata, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/007,625

(22) Filed: Jun. 13, 2018

(65) Prior Publication Data

US 2018/0364631 A1 Dec. 20, 2018

(30) Foreign Application Priority Data

Jun. 16, 2017 (JP) ..... 2017-118878
Aug. 21, 2017 (JP) ..... 2017-158665

(51) Int. Cl.
*G03G 15/20* (2006.01)
*G03G 15/00* (2006.01)

(52) U.S. Cl.
CPC ..... *G03G 15/55* (2013.01); *G03G 15/2028* (2013.01); *G03G 15/2064* (2013.01);
(Continued)

(58) Field of Classification Search
CPC .. G03G 15/55; G03G 15/553; G03G 15/2028; G03G 2215/00413;
(Continued)

(56) References Cited

U.S. PATENT DOCUMENTS 9,063,490 B2 * 6/2015 Tamada ..... G03G 15/50
9,207,603 B2 * 12/2015 Murakami ..... G03G 15/2046
(Continued)

FOREIGN PATENT DOCUMENTS

JP H0728364 1/1995
JP 2014-170212 9/2014
(Continued)

OTHER PUBLICATIONS

Extended European Search Report issued in corresponding European Patent Application No. 18175013.4-1022, dated Nov. 29, 2018 (9 pages).

*Primary Examiner* — Robert B Beatty
(74) *Attorney, Agent, or Firm* — Buchanan Ingersoll & Rooney PC

(57) ABSTRACT

Disclosed is image forming apparatus, including a first roller and a second roller that conveys the recording sheet by sandwiching the recording sheet in a fixing process of an image forming; a pressing actuator that presses the first roller and the second roller against each other; an actuating motor that actuates the first roller; a brake that applies a brake force to the second roller; a rotation speed detector that detects a rotation speed of the second roller; and a hardware processor that judges a degradation of each surface roughness of the first roller and the second roller in accordance with the rotation speed of the second roller, which is detected when the first roller is actuated in a situation in which the first roller and the second roller are pressed against each other and when the brake applies a predetermined brake force to the second roller.

19 Claims, 11 Drawing Sheets

(52) U.S. Cl.
CPC . *G03G 15/2032* (2013.01); *G03G 2215/2032* (2013.01); *G03G 2215/2045* (2013.01)

(58) Field of Classification Search
CPC ... G03G 2215/2009; G03G 2215/2016; G03G 2215/2045
USPC ..... 399/33, 36, 329
See application file for complete search history.

(56) References Cited

U.S. PATENT DOCUMENTS

| | | | | |
|---|---|---|---|---|
| 9,250,587 | B2 * | 2/2016 | Tamada ..... | G03G 15/2064 |
| 9,335,677 | B2 * | 5/2016 | Ogata ..... | G03G 15/2017 |
| 2014/0348527 | A1 * | 11/2014 | Murakami ..... | G03G 15/2028 399/67 |
| 2016/0378034 | A1 | 12/2016 | Taniguchi et al. | |

FOREIGN PATENT DOCUMENTS

| | | |
|---|---|---|
| JP | 2015-114610 | 6/2015 |
| JP | 2016-206635 A | 12/2016 |

* cited by examiner

FIG.10

BY STRENGTHENING BRAKE FORCE AND DECREASING FIXING TEMPERATURE, IMAGE QUALITY CAN BE SECURED ABOVE A CERTAIN LEVEL

SETTING VALUES ARE CHANGED IN THE ORDER OF BRAKE FORCE AND TEMPERATURE

| | LEVEL IMMEDIATELY AFTER THE REPLACEMENT | LIMIT VALUE | NEXT SETTING VALUE |
|---|---|---|---|
| BRAKE FORCE | LEVEL 4 | LEVEL 10 | LEVEL 7 |
| FIXING TEMPERATURE | YYY DEGREES | XXX DEGREES (YYY > XXX) | YYY DEGREES |

IMAGE FORMING APPARATUS AND LIFETIME JUDGMENT SYSTEM

The entire disclosure of Japanese Patent Applications No. 2017-118878 filed on Jun. 16, 2017 and No. 2017-158665 filed on Aug. 21, 2017, is incorporated herein by reference in its entirety.

BACKGROUND

Technological Field

The present invention relates to an image forming apparatus and a life judgment system which manage the replacement timing of the replacement part. Further, the present invention relates to an image forming apparatus which changes the fixing control parameter relating to the fixing of the image.

Description of the Related Art

In a device installed in an office or the like, such as a multi function peripheral having a copy function, a scan function, a print function and the like, in case that the part of the device is replaced after the lifetime of the part is ended and the part is ordered, it is inconvenient for a user to be unable to use the device for a long time. Therefore, the regular report indicating the usage amount and the like of each replacement part is regularly transmitted to a maintenance management device of the maintenance company via a network, and the replacement timing of each part is estimated by the maintenance management device. Before the lifetime of the part is ended, a new part is sent or the part is replaced with a new part by a serviceperson.

However, it is difficult to accurately estimate the lifetime of each part only by using the regular report. For example, the lifetime of each main member (a pair of rollers, a belt and a driving unit) used in the fixing device is generally judged in accordance with the operation time and the number of paper sheets used in the printing. In the PP (Production Printer) machine or the like, because the used conditions (the type of paper sheet, the size of paper sheet, the continuous operation and the like) are varied, the dispersion of the lifetime which is conventionally judged in accordance with the operation time and the number of paper sheets used in the printing becomes large.

Further, because the allowable range of the image quality is varied according to the users, it is difficult to uniformly judge the lifetime of the part in accordance with the conventional standard, such as the operation time, the number of paper sheets used in the printing, and the like.

In particular, the so-called gloss memory which is the phenomenon that the wax is moved from the toner image to the fixing members (rollers/belt) and is transferred to another image after one rotation of the belt, is gradually caused due to the degradation of the roughness of the surface of the fixing member. However, according to the type of paper sheet, the level of the actualization of the above phenomenon is varied. Even if the above phenomenon is caused, the visibility of the above phenomenon is varied according to the contents of the image. Further, the visibility of the above phenomenon is varied according to the users. From the above-described reasons, in accordance with the conventional standard, such as the operation time, the number of paper sheets used in the printing, and the like, it is difficult to judge whether the gloss memory is caused at the level in which there is some possibility that a complaint is made by the user (at the level in which the lifetime of the member is ended).

In Japanese Patent Application Publication No. 2016-206635, the technology for directly detecting the roughness of the surface of the fixing member by using the optical sensor is disclosed.

In Japanese Patent Application Publication No. 2016-206635, because the portion of the fixing member, which corresponds to the edge portion of the paper sheet is repaired, the roughness of the surface of the fixing member is detected at only a part of the fixing member (at the edge position of the paper sheet having the specified size) by the optical sensor. On the other hand, in order to judge the degree of the degradation of the fixing member due to the gloss memory, it is necessary to detect the roughness of the surface of the fixing member in the overall width of the fixing member. In case that the roughness is detected by using the method disclosed in Japanese Patent Application Publication No. 2016-206635, it is necessary to dispose many sensors or to have the structure for scanning the fixing member in the overall width thereof. However, because the optical sensor has the low durability to a high temperature, it is practically difficult to detect the roughness of the surface of the fixing member in the overall width thereof when the temperature of the fixing member is high.

Therefore, it is preferable to detect the change in the surface condition of the fixing member by using only the usual mechanism without adding the special mechanism, such as the optical sensors or the like.

Further, in the conventional method and the method disclosed in Japanese Patent Application Publication No. 2016-206635, because it is not possible to detect the degradation condition of the fixing member at a high accuracy, it is difficult to execute the process in which it is necessary to grasp the accurate degradation condition, for example, the process for changing the fixing control parameter used in the fixing step of the image forming in accordance with the degradation condition of the fixing member.

SUMMARY

One of the objects of the present invention is to provide an image forming apparatus and a lifetime judgment system which can detect the change in the surface condition of the fixing member by using only the usual mechanism. Further, one of the objects of the present invention is provide an image forming apparatus which can secure the image quality above a certain degree by using only the usual mechanism even if the surface condition of the fixing member is changed.

To achieve at least one of the abovementioned objects, according to an aspect of the present invention, an image forming apparatus reflecting one aspect of the present invention, comprises:

a first roller and a second roller that conveys the recording sheet by sandwiching the recording sheet between the first roller and the second roller in a fixing process of an image forming;

a pressing actuator that presses the first roller and the second roller against each other by a predetermined pressing force;

an actuating motor that actuates the first roller;

a brake that applies a brake force to the second roller;

a rotation speed detector that detects a rotation speed of the second roller; and a hardware processor that judges a degradation of each surface roughness of the first roller and the second roller in accordance with the rotation speed of the second roller, which is detected when the first roller is actuated at a predetermined rotation speed in a situation in which the first roller and the second roller are pressed against each other by the predetermined pressing force and when the brake applies a predetermined brake force to the second roller.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is an example of the fixing control parameter; and

DETAILED DESCRIPTION OF THE EMBODIMENTS

Hereinafter, one or more embodiments of the present invention will be described with reference to the drawings. However, the scope of the invention is not limited to the disclosed embodiments.

Figure 1:
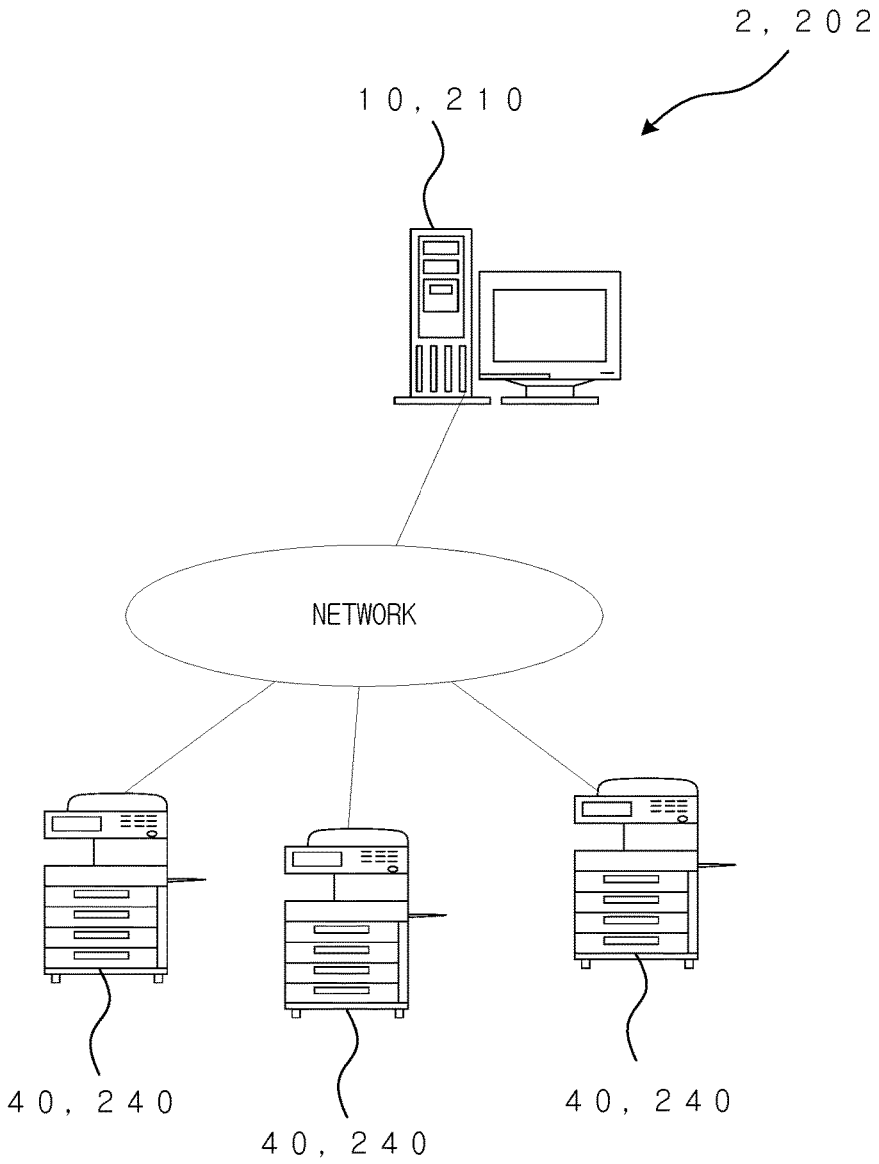
FIG. 1 is a view showing a configuration example of the maintenance management system according to the first embodiment and the second embodiment.

First Embodiment:

FIG. 1 shows a configuration example of the maintenance management system 2 according to the first embodiment. In the maintenance management system 2, the management server 10 which is the maintenance management device is connected with a plurality of image forming apparatuses 40 via a network, such as the Internet. The management server 10 is installed in a maintenance company for maintaining and managing the image forming apparatuses 40, or the like, and each image forming apparatus 40 is installed in an office or the like of each user.

The image forming apparatus 40 is a so-called multi function peripheral which has a copy function for printing an image of an original on a recording sheet by optically reading the original, a scan function for storing the image data obtained by optically reading an original as a file and transmitting the image data to an external terminal via the network, a print function for printing an image in accordance with the print data received from a user's information processing terminal, and the like.

The management server 10 monitors the abnormality of each image forming apparatus 40 to be maintained by being connected via the network, and manages the replacement timing of each replacement part in each image forming apparatus 40.

Each image forming apparatus 40 judges the degradation progress of the fixing member for fixing the image on the paper sheet in the printing by the method which will be explained below, and transmits the result of the judgment to the management server 10. Then, the management server 10 estimates each lifetime of the units in each image forming apparatus 40 in accordance with the degradation progress indicated in the result of the judgment, which is received from each image forming apparatus 40.

Figure 2:
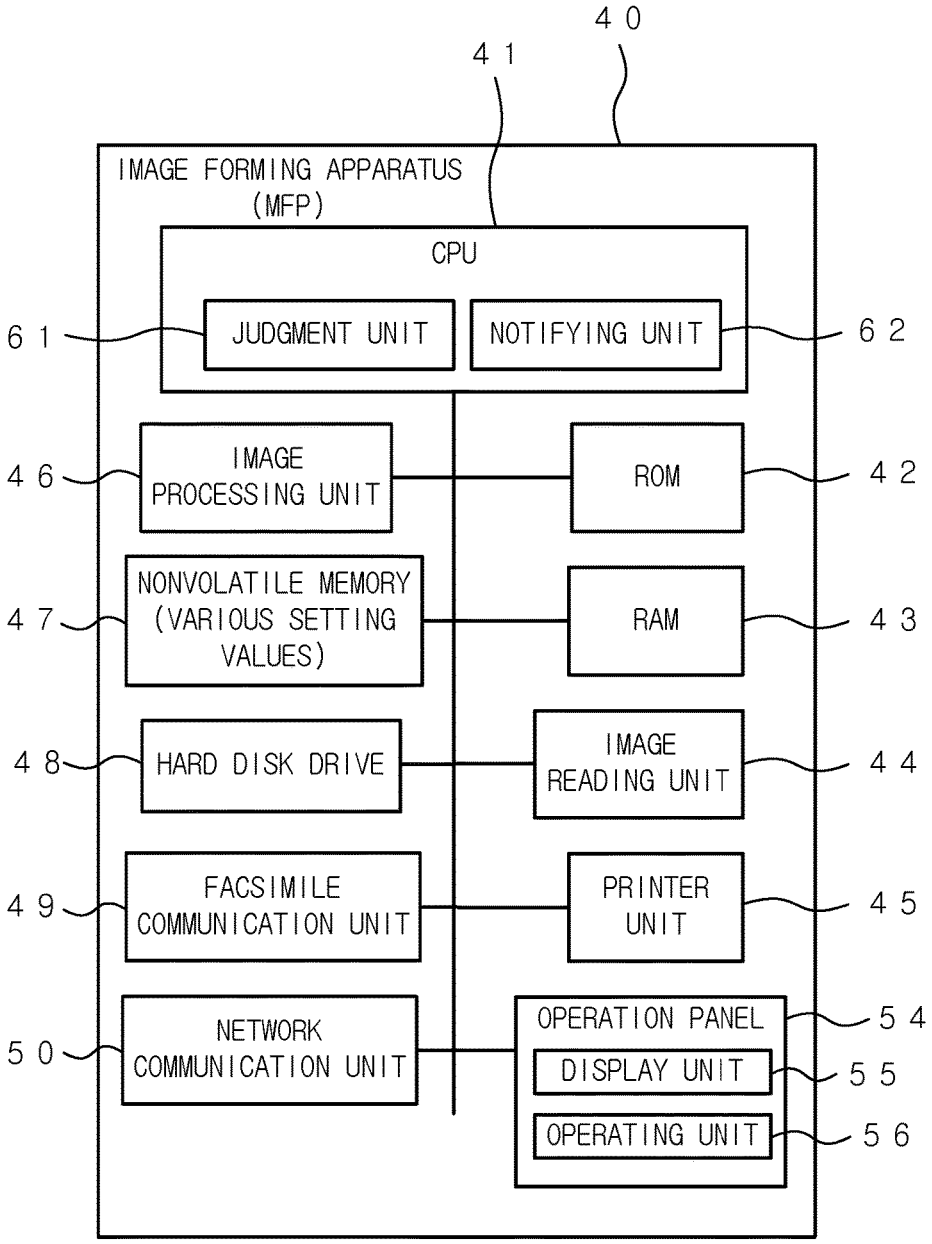
FIG. 2 is a block diagram showing the schematic configuration of the image forming apparatus according to the first embodiment.

FIG. 2 is a block diagram showing the schematic configuration of the image forming apparatus 40. The image forming apparatus 40 comprises a CPU (Central Processing Unit) 41 for entirely controlling the operation of the image forming apparatus 40. The CPU 41 is connected with a ROM (Read Only Memory) 42, a RAM (Random Access Memory) 43, an image reading unit 44, a printer unit 45, an image processing unit 46, a nonvolatile memory 47, a hard disk drive 48, a facsimile communication unit 49, a network communication unit 50, an operation panel 54 and the like via a bus.

By the CPU 41, a middleware, application programs and the like are executed on an OS (Operating System) program as a base. In the ROM 42, various types of programs are stored. By executing various types of processes by the CPU 41 in accordance with these programs, each function of the image forming apparatus 40 is realized.

The RAM 43 is used as a work memory for temporarily storing various data when the CPU 41 executes the process in accordance with the programs, an image memory for storing an image data, and the like.

The image reading unit 44 has the function for the function for obtaining the image data by optically reading the original. For example, the image reading unit 44 comprises a light source for irradiating an original set on the platen glass with light, a line image sensor for reading the original line by line in the width direction of the original by receiving the reflected light from the original, a moving unit for sequentially moving the position in which the light source irradiates the original with the light and the reading position of the line image sensor line by line in the longitudinal direction of the original, an optical system having lenses, mirrors, and the like for guiding the reflected light from the original to the line image sensor and focusing the reflected light on the line image sensor, a converting unit for converting an analog image signal outputted from the line image sensor into digital image data, and the like.

Figure 3:
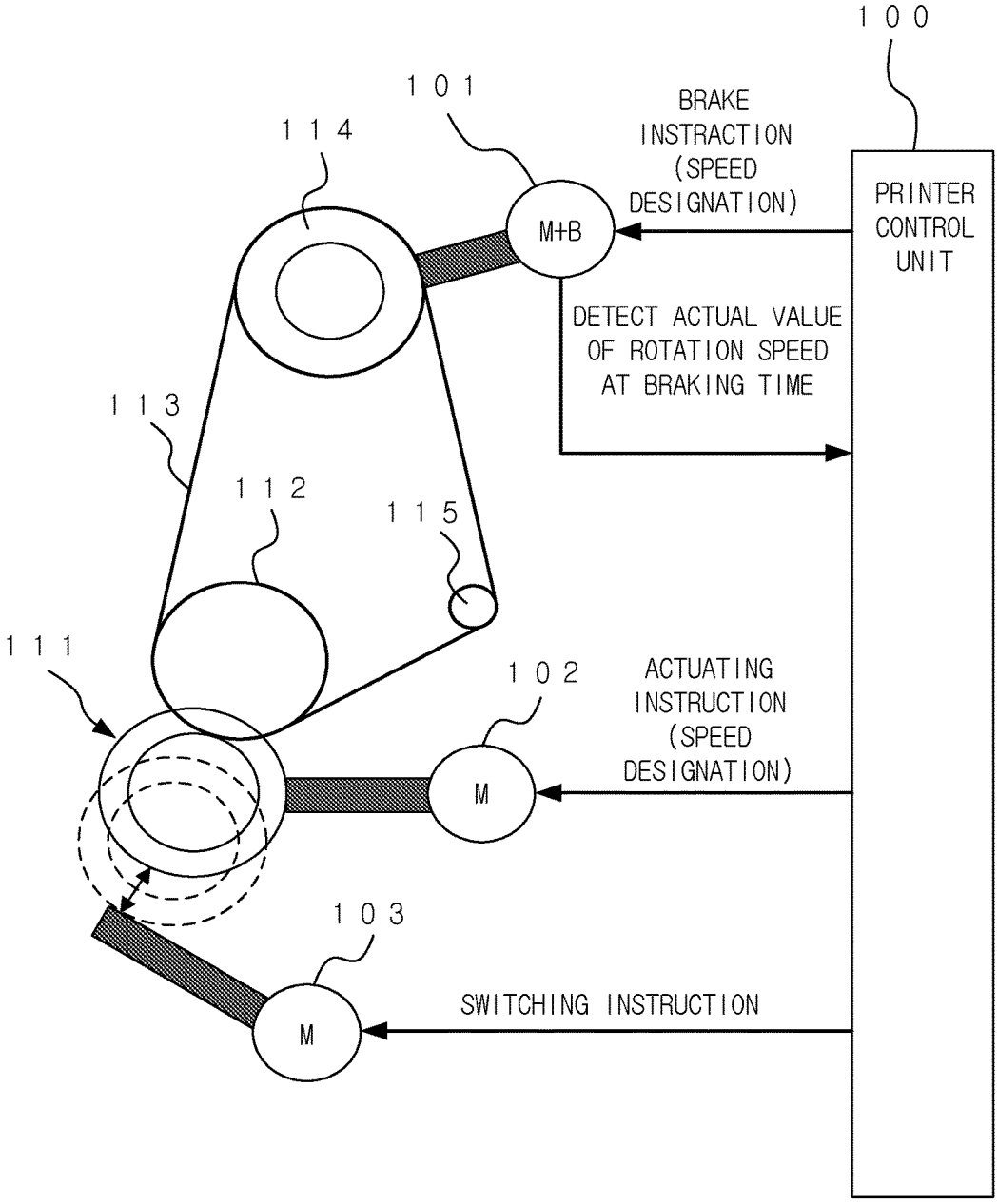
FIG. 3 is a view showing the configuration including a pair of rollers and parts for actuating the rollers according to the first embodiment.

The printer unit 45 has the function for forming an image on the recording sheet in accordance with the image data. In this embodiment, the print unit 45 is configured as a so-called laser printer which comprises a conveying device for the recording sheet, a photoconductive drum, a charging device, a laser unit, a developing device, a transfer and separation device, a cleaning device and the fixing device, and which forms an image by the electrophotographic process. The image may be formed by another method. The fixing device fixes the toner image on the recording sheet by heating and pressing the recording sheet in the fixing process of the image forming. The fixing device comprises a pair of fixing rollers which are pressed against each other, a fixing lump which is inserted in the fixing roller and which heats the fixing roller, and the like. The fixing roller and the fixing lump are the replacement parts to be managed. As shown in FIG. 3, the fixing device may have the configuration in which a plurality of rollers and the belt which is bridged to the rollers are substituted for one of the fixing rollers.

The image processing unit 46 carries out the rasterizing process for converting print data included in the print job into image data, the compression/decompression process for the image data, and the like in addition to the processings, such as the enlargement/reduction or the rotation of image data.

The nonvolatile memory 47 is a memory (flash memory) in which the stored contents are not damaged even if the image forming apparatus 40 is turned off, and is used for storing various types of setting values.

The hard disk drive 48 is a large-capacity nonvolatile memory device. In the hard disk drive 48, various types of programs, the received print jobs and the like, are stored.

The facsimile communication unit 49 has the function for transmitting and receiving the image data to/from an external device having the facsimile function via a public line.

The network communication unit 50 has the function for communicating the data with the management server 10, the information processing terminal of each user, the information processing terminal of the administrator, and another external device via the network.

The operation panel 54 comprises a display unit 55 and an operating unit 56. The display unit 55 comprises a liquid crystal display (LCD) and the like, and has the function for displaying various types of operation windows, setting windows and the like. The operating unit 56 comprises some hardware keys, such as a numeric keypad, a start button and the like, and the touch panel provided on the physical screen of the display unit 55. The touch panel detects the coordinate position on which a touch pen, the user's finger or the like comes into contact with the physical screen of the display unit 55 to operate the image forming apparatus 40.

The CPU 41 of the image forming apparatus 40 has the function as the judgment unit 61 and the notifying unit 62 by executing the programs. The judgment unit 61 has the function for judging the degradation progress of the fixing member of the fixing device in the printer unit 45. The judgment method and the degradation to be judged will be explained in detail. The notifying unit 62 notifies the user of the judgment result obtained by judgment unit 61 via the display unit 55 or the like. Further, the notifying unit 62 transmits the judgment result to the management server 10 via the network communication unit 50.

Next, the degradation to be judged and the judgment method will be explained with reference to FIG. 3. FIG. 3 shows an example of the configuration of the fixing device in the printer unit 45.

The fixing device comprises a pair of fixing rollers (including the belt and the like) for conveying the recording sheet by sandwiching the recording sheet in the fixing process of the image forming, an actuating motor 102 for actuating one of the fixing rollers, a brake unit 101 for applying the brake force to the other fixing roller and a switching unit 103 (pressing unit) for switching the state of a pair of fixing rollers between the pressing state and the separation state. The brake unit 101 has the function as the speed detection unit for detecting the rotation speed of the other fixing roller.

A pair of the fixing rollers include a first roller 111 having a hollow cylindrical shape and a second roller 112 disposed on the upper side of the first roller 111 so as to face to the first roller 111. The shaft of the first roller 111 is parallel with that of the second roller 112. Further, each of the first roller 111 and the second roller 112 has the length which is longer than the maximum width of the recording sheet to be used in the image forming apparatus 40. In this embodiment, the diameter of the first roller 111 is the same as that of the second roller 112.

The switching unit 103 reciprocates the first roller 111 between the contact position in which the first roller 111 and the second roller 112 are in the pressing state (both of them are pressed against each other) and the separation position in which the first roller 111 and the second roller 112 are in the separation state. Further, it is possible to adjust the strength of the pressing force in the pressing state.

The actuating motor 102 actuates and rotates the first roller 111. In case that the first roller 111 and the second roller 112 are in the pressing state, the actuating force which is applied to the first roller 111 by the actuating motor 102 is transmitted to the second roller 112 via the first roller 111. Then, the second roller 112 is driven.

In this embodiment, the second roller 112, the brake roller 114 and the auxiliary roller 115 are disposed so that the shafts of the above three rollers are parallel with each other. Further, the lengths in the shaft direction of the above three rollers are the same. The belt 113 is bridged so as to transmit the actuating force among the above three rollers and to surround the above three rollers. The belt 113 has substantially the same width as the second roller 112, the brake roller 114 and the auxiliary roller 115, and is bridged throughout the whole width of each roller. Between the belt 113 and each roller (the second roller 112, the brake roller 114 and the auxiliary roller 115), there is no slip. During the pressing state, the first roller 111 and the second roller 112 are pressed against each other via the belt 113. The recording sheet on which the toner image is fixed, is passed between the first roller 111 and the belt 113.

The brake unit 101 is a motor, and applies the actuating force and the brake force to the brake roller 114. In the normal state, the brake unit 101 applies the actuating force in the same direction as the actuating force which is transmitted from the first roller 111 to the second roller 112, and assists the drive of the belt 113. The actuating force which is applied to the brake roller 114 by the brake unit 101 causes the lap speed (movement speed) of the belt 113 actuated via the brake roller 114 to be the same as the lap speed of the periphery of the first roller 111 (the movement speed of the periphery of the first roller 111) in case that the actuating motor 102 actuates the first roller 111.

In case that the brake unit 101 applies the brake force, the brake unit 101 weakens the actuating force more than the actuating force in the above normal state and reduces the lap speed of the brake roller 114, or the brake unit 101 applies the actuating force in the opposite direction of the actuating force in the above normal state. The brake force applied to the brake roller 114 is transmitted to the second roller 112 and the auxiliary roller 115 via the belt 113.

The torque caused on the second roller 112 side is set so as to be smaller than the torque caused on the first roller 111 side. Even if a weak brake force is applied by the brake unit 101 (even if the rotation speed is reduced more than the rotation speed in the normal state), when the frictional force between the first roller 111 and the belt 113 is large, the belt 113 rotates at the speed of the first roller 111 side and the motor of the brake unit 101 rotates at a higher speed than the rotation speed designated by the printer control unit 100. As the frictional force between the first roller 111 and the belt 113 becomes small due to the degradation or the like, the motor of the brake unit 101 rotates at the rotation speed which is approximately the rotation speed designated by the printer control unit 100. The brake unit 101 which functions as the speed detection unit, detects the actual value of the rotation speed of the motor of the brake unit 101, and transmits the detected actual value to the printer control unit 100 which will be explained later.

The printer control unit 100 controls each operation of the switching unit 103, the actuating motor 102 and the brake unit 101. For example, the printer control unit 100 designates the rotation speed, the rotation direction and the like of the actuating motor 102 and the brake unit 101 in case that the printer control unit 100 instructs each motor to rotate.

In this embodiment, the judgment unit 61 judges the degradation of each surface roughness of the first roller 111 and the belt 113. However, hereinafter, in the explanation relating to the judgment of the degradation, a simple configuration in which the belt 113 is omitted is used. That is, in this explanation, the degradation to be judged is the degradation of the first roller 111 and the degradation of the second roller 112. The first roller 111 and the second roller 112 are pressed against each other, and the brake unit 101 gives the brake force to the second roller 112 and detects the rotation speed of the second roller 112.

When the surface of the first roller 111 and the surface of the second roller 112 which contact with each other are degraded, the adhesion between the first roller 111 and the second roller 112 is decreased because the surface of the first roller 111 and the surface of the second roller 112 become rough. As a result, the first roller 111 and the second roller 112 easily slip. Therefore, in case that brake unit 101 applies the brake force having the predetermined strength to the second roller 112 when the first roller 111 is actuated at the predetermined rotation speed in the pressing state in which the first roller 111 and the second roller 112 are pressed against each other by the predetermined pressing force (hereinafter, simply referred to as the brake process judgment time), the judgment unit 61 judges the degradation of the roughness of the portion at which the first roller 111 and the second roller 112 contact with each other, in accordance with the rotation speed of the second roller 112.

As the degradation progresses, the first roller 111 and the second roller 112 easily slip. Because it is hard to transmit the actuating force from the first roller 111 to the second roller 112, the rotation speed of the second roller 112 in the brake process judgment time is decreased. The judgment unit 61 judges that the degradation of the roughness of the portion at which the first roller 111 and the second roller 112 contact with each other progresses as the rotation speed of the second roller 112 in the brake process judgment time is decreased.

In this embodiment, at the above-described judgment, the rotation speed of the first roller 111 in the brake process judgment time is compared with that of the second roller 112 in the brake process judgment time. As the difference therebetween is large, it is judged that the degradation of the roughness of the portion at which the first roller 111 and the second roller 112 contact with each other progresses. Further, in this embodiment, the rotation speed of the actuating motor 102 is linearly proportional to the rotation speed of the first roller 111, and the actual value of the rotation speed of the motor of the brake unit 101 is linearly proportional to the rotation speed of the second roller 112. The rotation speed of the first roller 111 is calculated from the rotation speed of the actuating motor 102. Further, the rotation speed of the second roller 112 is calculated from the actual value of the rotation speed of the motor of the brake unit 101.

The rotation speed of the first roller 111 and the rotation speed of the second roller 112 correspond to, for example, the lap speed (movement speed) of the periphery of each roller, the rotation speed of the rotation shaft of each roller or the like.

The rotation speed of the actuating motor 102 is the rotation speed which is designated when the printer control unit 100 actuates the actuating motor 102. The actual value of the rotation speed of the motor of the brake unit 101 is detected by the brake unit 101, and the result of the detection of the actual value is transmitted to the printer control unit 100. The judgment unit 61 judges the degradation of the roughness of the portion at which the he first roller 111 and the second roller 112 contact with each other, in accordance with the difference between the rotation speed of the actuating motor 102 and the actual value of the rotation speed of the motor of the brake unit 101, which is obtained by the printer control unit 100. The actual value of the rotation speed of the first roller 111 may be detected.

The judgment method which is explained above is referred to as the first judgment method. Hereinafter, the judgment method except the first judgment method will be explained.

Next, the second judgment method for judging the degradation more precisely than the above first judgment method will be explained. According to the second judgment method, in the brake process judgment time, the brake force is applied to the second roller 112 so as to change the strength thereof in the multistage manner. Then, the rotation speed of the second roller 112 (the actual value of the rotation speed of the motor of the brake unit 101) in each stage is investigated.

Figure 4:
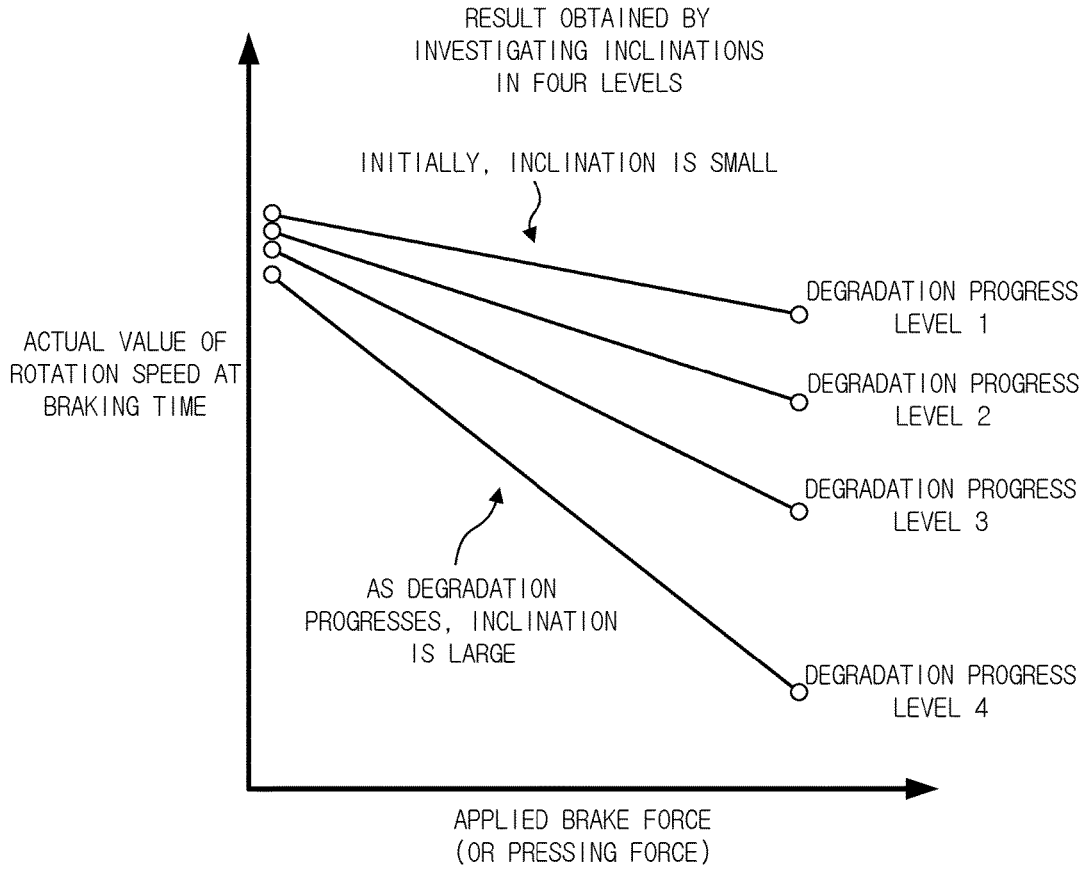
FIG. 4 is a view showing each relation between the strength of the brake force (pressing force) and the rotation speed of the second roller, in four degradation progress levels according to the first embodiment.

FIG. 4 shows the relation between the brake force applied to the second roller 112, that is, the brake force (rotation speed) designated to the motor of the brake unit 101 and the rotation speed of the second roller 112 (the actual value of the rotation speed of the motor of the brake unit 101) in each degradation progress of the first roller 111 and the second roller 112 by using four graphs (degradation progress levels 1 to 4). The degradation progresses in the order of the degradation progress level 1, the degradation progress level 2, the degradation progress level 3 and the degradation progress level 4.

In FIG. 4, as indicated in the four graphs, when the degradation progresses, the difference between the rotation speed of the second roller 112 (the actual value of the rotation speed of the motor of the brake unit 101), which is measured when the brake force is weakly applied and the rotation speed of the second roller 112, which is measured when the brake force is strongly applied, is large. Further, as the degradation progresses, the inclination of the graph becomes large.

Therefore, the judgment unit 61 calculates the change ratio of the actual rotation speed to the brake force in accordance with the change in the rotation speed of the second roller 112 (the actual value of the rotation speed of the motor of the brake unit 101) in each stage in case that the brake force is applied to the second roller 112 so as to change the strength thereof in the multistage manner. As the calculated change ratio is large (as the inclination of the graph is large), the judgment unit 61 judges that the degradation of the roughness of the portion at which the first roller 111 and the second roller 112 contact with each other progresses.

The first judgment method and the second judgment method may be used combinationally. Alternatively, only one of the methods may be used. In the second judgment method, when the brake force is applied so as to change the strength thereof in the multistage manner, the situation in which the brake force is not applied may be set as one stage.

In the second judgment method, instead of the brake force, the pressing force which is applied between the first roller 111 and the second roller 112 may be changed in the multistage manner. In this case, the brake force to be applied in each stage is constant. Also in case that the pressing force is changed in the multistage manner, like the graphs shown in FIG. 4, when the degradation progresses, the difference between the rotation speed of the second roller 112, which is measured when the pressing force is weakly applied and the rotation speed of the second roller 112, which is measured when the pressing force is strongly applied (the change ratio of the actual rotation speed to the pressing force), is large. Further, as the degradation progresses, the inclination of the graph becomes large. In the brake process judgment time, by changing the pressing force between first roller 111 and the second roller 112 in the multistage manner and by comparing the rotation speed of the second roller 112 in one stage with the rotation speed in another stage, the judgment unit 61 judges that the degradation progresses as the above difference (the inclination of the graph) is large.

In this embodiment, the timing at which the judgment unit 61 judges the degradation is, for example, the first warming up (the starting up) of the image forming apparatus 40 every morning. Alternatively, the judgment may be carried out at another timing. For example, the judgment may be carried out when the predetermined time comes, when the images are printed on the predetermined number of recording sheets, or when the instruction for carrying out the judgment is received via the management server 10 or the operating unit 56.

Figure 5:
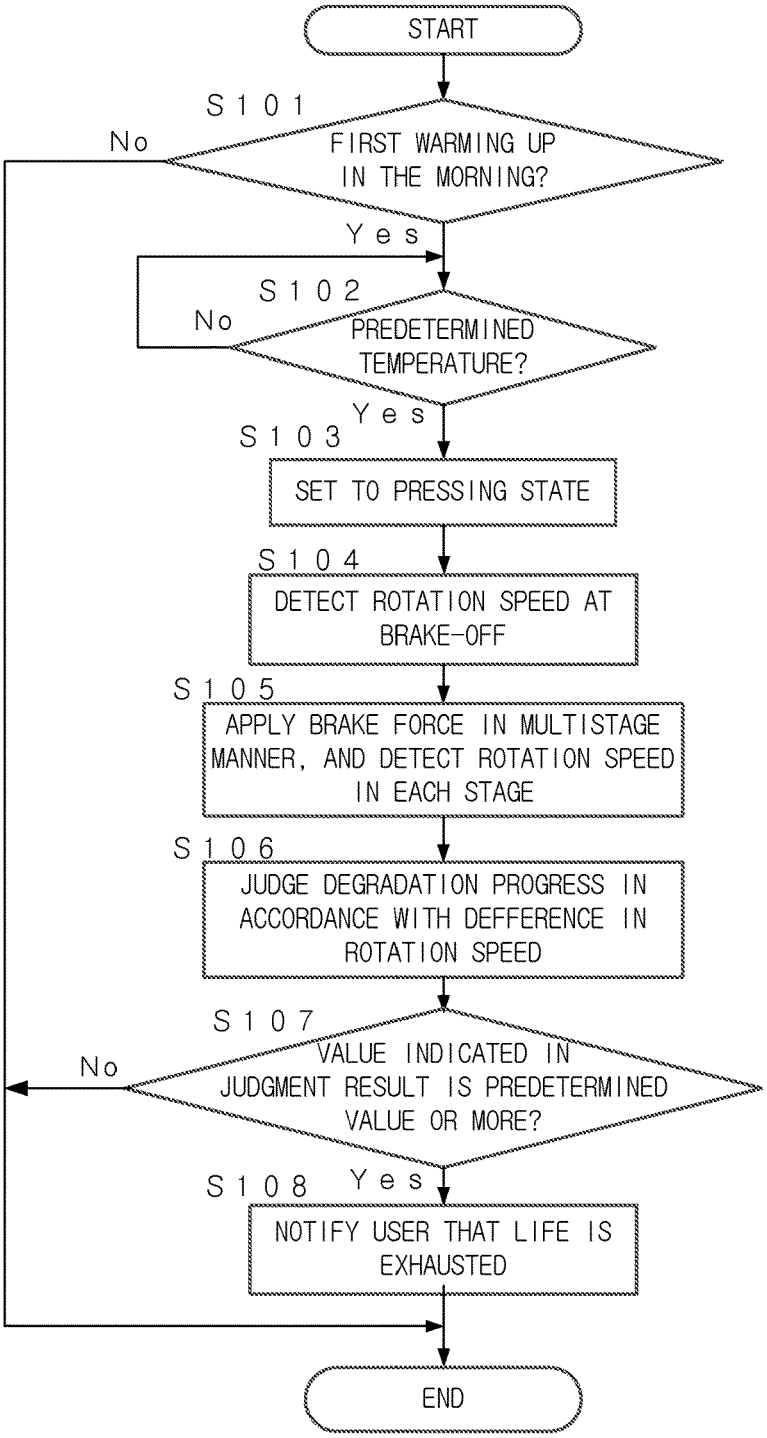
FIG. 5 is a flowchart showing the process for judging the degradation progress of the surface of the fixing member by the image forming apparatus according to the first embodiment.

FIG. 5 shows the process for judging the degradation progress of the roughness of each surface of the first roller 111 and the second roller 112, which is carried out by the image forming apparatus 40. Firstly, in case that the first warming up in a day (the first warming up in the morning) is not currently carried out for the image forming apparatus 40 (Step S101; No), the process is ended. On the other hand, in case that the first warming up in a day is currently carried out for the image forming apparatus 40 (Step S101; Yes), the image forming apparatus 40 waits until the inside temperature of the image forming apparatus 40 is increased to the predetermined temperature by the warming up (Step S102; No). When the inside temperature of the image forming apparatus 40 reaches the predetermined temperature (Step S102; Yes), the first roller 111 and the second roller 112 are set to the pressing state by the predetermined pressing force (Step S103).

Next, in the normal state, that is, in the situation in which the brake unit 101 does not apply the brake force, the image forming apparatus 40 actuates the actuating motor 102 (the first roller 111) at the predetermined rotation speed. Then, the image forming apparatus 40 detects the actual value of the rotation speed of the motor of the brake unit 101 (the second roller 112) (Step S104).

Next, the image forming apparatus 40 instructs the brake unit 101 to apply the brake force so as to change the strength thereof in the multistage manner, and actuates the actuating motor 102 (the first roller 111) at the predetermined rotation speed. Then, the image forming apparatus 40 detects the actual value of the rotation speed of the motor of the brake unit 101 (the second roller 112) in each stage (Step S105).

The image forming apparatus 40 judges the degradation progress of the roughness of each surface of the first roller 111 and the second roller 112 in accordance with each rotation speed detected in Step S104 and Step S105 (Step S106). In this case, the image forming apparatus 40 calculates the change ratio of the actual rotation speed of the second roller 112 to the change in the brake force, and judges the degradation progress in accordance with the calculated change ratio.

In case that the value indicated in the judgment result (the degradation progress) is less than the predetermined value (Step S107; No), the process is ended. On the other hand, in case that the value indicated in the judgment result is the predetermined value or more (Step S107; Yes), the image forming apparatus 40 judges that each life of the first roller 111 and the second roller 112 is exhausted, and notifies the user of the above judgment (Step S108). Then, the process is ended. A user can set the predetermined value used in Step S107.

In this embodiment, the image forming apparatus 40 transmits the judgment result to the management server 10 regardless of whether the value indicated in the judgment result in Step S107 reaches the predetermined value. Only in case that the value reaches the predetermined value, the image forming apparatus 40 may transmits the judgment result to the management server 10.

The management server 10 stores the judgment result received from each image forming apparatus 40 and estimates the lifetime of the unit of the fixing members in each image forming apparatus 40 in accordance with the stored judgment result.

For example, when the fixing device is replaced in each image forming apparatus 40, the management server 10 collects the degradation progress of the fixing device which is judged immediately before the fixing device is replaced and the information indicating the usage condition of the image forming apparatus 40. The collected information indicating the usage condition, includes the information indicating the usage frequency of each type of the recording sheets, the type of the recording sheet to be mainly used, the type of user and the like. Then, in accordance with the collection of the above information from a plurality of image forming apparatuses 40, for example, in accordance with the type of the recording sheet to be mainly used, the management server 10 determines the threshold value of the degradation progress, which is used for judging the replacement timing (the lifetime) of the fixing device. Then, the management server 10 notifies each image forming apparatus 40 of the threshold value which is determined in accordance with the type of the recoding sheet to be mainly used in the image forming apparatus 40, and instructs each image forming apparatus 40 to judge the lifetime of the fixing device by using the threshold value. Alternatively, the management server 10 judges the lifetime of the fixing device of each image forming apparatus 40 in accordance with the usage condition thereof.

As described above, when the first roller 111 is actuated by the predetermined actuating force in the pressing state in which the first roller 111 and the second roller 112 are pressed against each other by the predetermined pressing force, the image forming apparatus 40 judges the degradation progress of the roughness of each surface of the first roller 111 and the second roller 112 (the belt 113) in accordance with the rotation speed of the second roller 112 which is measured when the brake unit 101 applies the predetermined brake force to the second roller 112. Thereby, without requiring a special mechanism, it is possible to judge the degradation of each surface roughness of the first roller 111 and the second roller 112 by using only the usual mechanism.

Second Embodiment:

Next, the maintenance management system 202 according to the second embodiment will be explained. As shown in FIG. 1, the maintenance management system 202 comprises a plurality of image forming apparatuses 240 and a management server 210 which is the maintenance management device, and has the same configuration as the maintenance management system 2 according to the first embodiment.

The image forming apparatus 240 is a so-called multi function peripheral like the image forming apparatus 40 according to the first embodiment. In the second embodiment, each image forming apparatus 240 judges the degradation progress of the fixing member for fixing the image on the paper sheet in the printing by the method which will be explained below, and changes the fixing control parameter for the image forming in accordance with the above judgment result to maintain the image quality above a certain level. Further, when the life of the fixing member is exhausted, the image forming apparatus 240 transmits the information indicating that the life of the fixing member is exhausted, to the management server 210.

The management server 210 monitors the abnormality of each image forming apparatus 240 to be maintained by being connected via the network, and manages the replacement timing of each replacement part in each image forming apparatus 240, like the management server 10 according to the first embodiment.

Figure 6:
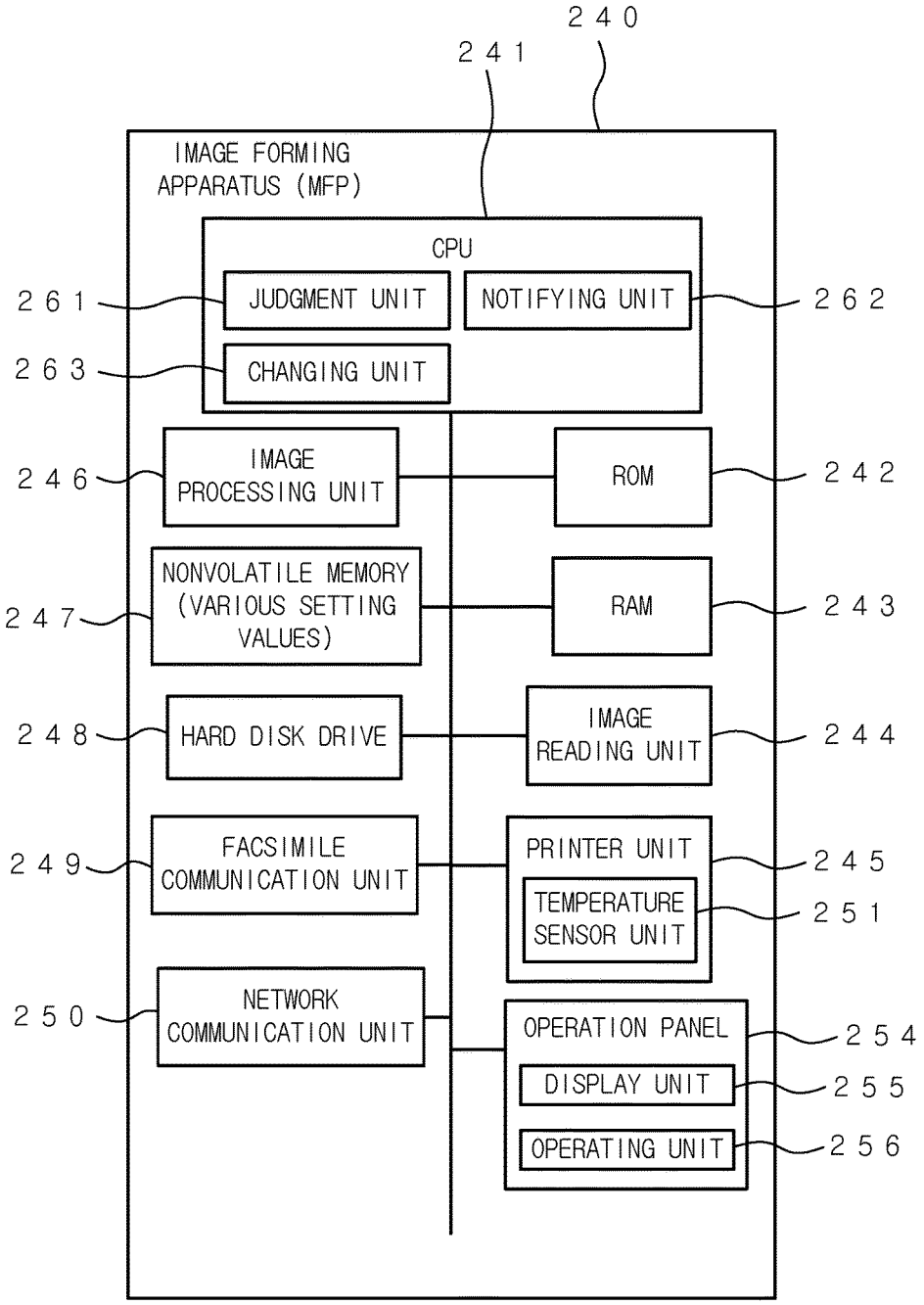
FIG. 6 is a block diagram showing the schematic configuration of the image forming apparatus according to the second embodiment.

FIG. 6 is a block diagram showing the schematic configuration of the image forming apparatus 240. The image forming apparatus 240 comprises a CPU 241 for entirely controlling the operation of the image forming apparatus 240. The CPU 241 is connected with a ROM 242, a RAM 243, an image reading unit 244, a printer unit 245, an image processing unit 246, a nonvolatile memory 247, a hard disk drive 248, a facsimile communication unit 249, a network communication unit 250, an operation panel 254 and the like via a bus.

By the CPU 241, a middleware, application programs and the like are executed on an OS program as a base. In the ROM 242, various types of programs are stored. By executing various types of processes by the CPU 241 in accordance with these programs, each function of the image forming apparatus 240 is realized.

The RAM 243 is used as a work memory for temporarily storing various data when the CPU 241 executes the process in accordance with the programs, an image memory for storing an image data, and the like.

The image reading unit 244 has the function for the function for obtaining the image data by optically reading the original. For example, the image reading unit 244 comprises a light source for irradiating an original set on the platen glass with light, a line image sensor for reading the original line by line in the width direction of the original by receiving the reflected light from the original, a moving unit for sequentially moving the position in which the light source irradiates the original with the light and the reading position of the line image sensor line by line in the longitudinal direction of the original, an optical system having lenses, mirrors, and the like for guiding the reflected light from the original to the line image sensor and focusing the reflected light on the line image sensor, a converting unit for converting an analog image signal outputted from the line image sensor into digital image data, and the like.

Figure 7:
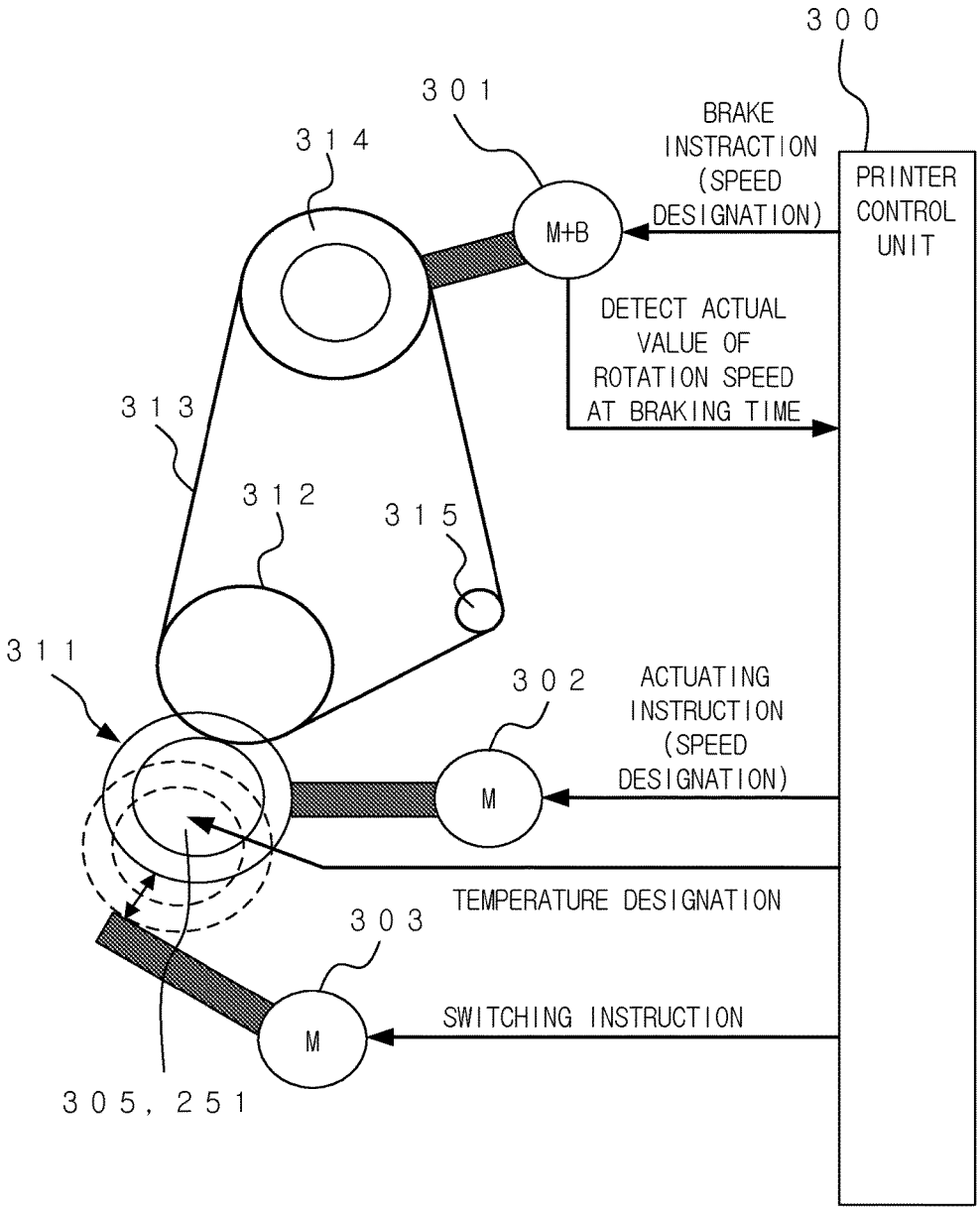
FIG. 7 is a view showing the configuration including a pair of rollers and parts for actuating the rollers according to the second embodiment.

The printer unit 245 has the function for forming an image on the recording sheet in accordance with the image data. In this embodiment, the print unit 245 is configured as a so-called laser printer which comprises a conveying device for the recording sheet, a photoconductive drum, a charging device, a laser unit, a developing device, a transfer and separation device, a cleaning device and the fixing device, and which forms an image by the electrophotographic process. The image may be formed by another method. The fixing device fixes the toner image on the recording sheet by heating and pressing the recording sheet in the fixing process of the image forming. The fixing device comprises a pair of fixing rollers which are pressed against each other, a fixing lump 305 (See FIG. 7) which is inserted in the fixing roller and which heats the fixing roller, and the like. The fixing roller and the fixing lump 305 are the replacement parts to be managed. As shown in FIG. 7, the fixing device may have the configuration in which a plurality of rollers and the belt which is bridged to the rollers are substituted for one of the fixing rollers.

The above-described fixing lump 305 has the function as the heating unit. Further, the print unit 245 comprises a temperature sensor unit 251 for detecting the temperature of the fixing roller which is heated by the fixing lump 305. The temperature sensor unit 251 detects the temperature of the fixing place in the fixing process of the image forming. Specifically, the temperature sensor unit 251 directly detects the temperature of the surface of the fixing roller, or indirectly detects the temperature of the surface of the fixing roller by detecting the temperature of the shaft of the fixing roller or the like.

The image processing unit 246 carries out the rasterizing process for converting print data included in the print job into image data, the compression/decompression process for the image data, and the like in addition to the processings, such as the enlargement/reduction or the rotation of image data.

The nonvolatile memory 247 is a memory (flash memory) in which the stored contents are not damaged even if the image forming apparatus 240 is turned off, and is used for storing various types of setting values.

The hard disk drive 248 is a large-capacity nonvolatile memory device. In the hard disk drive 248, various types of programs, the received print jobs and the like, are stored.

The facsimile communication unit 249 has the function for transmitting and receiving the image data to/from an external device having the facsimile function via a public line.

The network communication unit 250 has the function for communicating the data with the management server 210, the information processing terminal of each user, the information processing terminal of the administrator, and another external device via the network.

The operation panel 254 comprises a display unit 255 and an operating unit 256. The display unit 255 comprises a liquid crystal display (LCD) and the like, and has the function for displaying various types of operation windows, setting windows and the like. The operating unit 256 comprises some hardware keys, such as a numeric keypad, a start button and the like, and the touch panel provided on the physical screen of the display unit 255. The touch panel detects the coordinate position on which a touch pen, the user's finger or the like comes into contact with the physical screen of the display unit 255 to operate the image forming apparatus 240.

The CPU 241 of the image forming apparatus 240 has the function as the judgment unit 261, the notifying unit 262 and the changing unit 263 by executing the programs. The judgment unit 261 has the function for judging the degradation progress of the fixing member of the fixing device in the printer unit 245. The changing unit 263 has the function for changing the fixing control parameter for the image forming in accordance with the judgment result obtained by the judgment unit 261. The fixing control parameter includes the fixing temperature and the like, and will be explained later. The notifying unit 262 has the function for notifying the user or the management server 210 of the information indicating that the life of the fixing member is exhausted, in case that it is judged that the fixing member is degraded and the life thereof is exhausted.

Next, the degradation to be judged and the judgment method will be explained with reference to FIG. 7. FIG. 7 shows an example of the configuration of the fixing device in the printer unit 245.

The fixing device comprises a pair of fixing rollers (including the belt and the like) for conveying the recording sheet by sandwiching the recording sheet in the fixing process of the image forming, an actuating motor 302 for actuating one of the fixing rollers, a brake unit 301 for applying the brake force to the other fixing roller and a switching unit 303 (pressing unit) for switching the state of a pair of fixing rollers between the pressing state and the separation state. The brake unit 301 has the function as the speed measurement unit for detecting the rotation speed of the other fixing roller.

A pair of the fixing rollers include a first roller 311 having a hollow cylindrical shape and a second roller 312 disposed on the upper side of the first roller 311 so as to face to the first roller 311. The shaft of the first roller 311 is parallel with that of the second roller 312. Further, each of the first roller 311 and the second roller 312 has the length which is longer than the maximum width of the recording sheet to be used in the image forming apparatus 240. In this embodiment, the diameter of the first roller 311 is the same as that of the second roller 312. Further, the above-described fixing lump 305 is provided in the first roller 311. The temperature sensor unit 251 for measuring the temperature of the fixing place (member) (the temperature of the first roller 311 (in particular, the surface temperature)) is provided.

The switching unit 303 reciprocates the first roller 311 between the contact position in which the first roller 311 and the second roller 312 are in the pressing state (both of them are pressed against each other) and the separation position in which the first roller 311 and the second roller 312 are in the separation state. Further, it is possible to adjust the strength of the pressing force in the pressing state.

The actuating motor 302 actuates and rotates the first roller 311. In case that the first roller 311 and the second roller 312 are in the pressing state, the actuating force which is applied to the first roller 311 by the actuating motor 302 is transmitted to the second roller 312 via the first roller 311. Then, the second roller 312 is driven.

In this embodiment, the second roller 312, the brake roller 314 and the auxiliary roller 315 are disposed so that the shafts of the above three rollers are parallel with each other. Further, the lengths in the shaft direction of the above three rollers are the same. The belt 313 is bridged so as to transmit the actuating force among the above three rollers and to surround the above three rollers. The belt 313 has substantially the same width as the second roller 312, the brake roller 314 and the auxiliary roller 315, and is bridged throughout the whole width of each roller. Between the belt 313 and each roller (the second roller 312, the brake roller 314 and the auxiliary roller 315), there is no slip. During the pressing state, the first roller 311 and the second roller 312 are pressed against each other via the belt 313. The recording sheet on which the toner image is fixed, is passed between the first roller 311 and the belt 313.

The brake unit 301 is a motor, and applies the actuating force and the brake force to the brake roller 314. In the normal state, the brake unit 301 applies the actuating force in the same direction as the actuating force which is transmitted from the first roller 311 to the second roller 312, and assists the drive of the belt 313. The actuating force which is applied to the brake roller 314 by the brake unit 301 causes the lap speed (movement speed) of the belt 313 actuated via the brake roller 314 to be the same as the lap speed of the periphery of the first roller 311 (the movement speed of the periphery of the first roller 311) in case that the actuating motor 302 actuates the first roller 311.

In case that the brake unit 301 applies the brake force, the brake unit 301 weakens the actuating force more than the actuating force in the above normal state and reduces the lap speed of the brake roller 314, or the brake unit 301 applies the actuating force in the opposite direction of the actuating force in the above normal state. The brake force applied to the brake roller 314 is transmitted to the second roller 312 and the auxiliary roller 315 via the belt 313.

The torque caused on the second roller 312 side is set so as to be smaller than the torque caused on the first roller 311 side. Even if a weak brake force is applied by the brake unit 301 (even if the rotation speed is reduced more than the rotation speed in the normal state), when the frictional force between the first roller 311 and the belt 313 is large, the belt 313 rotates at the speed of the first roller 311 side and the motor of the brake unit 301 rotates at a higher speed than the rotation speed designated by the printer control unit 300. As the frictional force between the first roller 311 and the belt 313 becomes small due to the degradation or the like, the motor of the brake unit 301 rotates at the rotation speed which is approximately the rotation speed designated by the printer control unit 300. The brake unit 301 which functions as the speed measurement unit, detects the actual value of the rotation speed of the motor of the brake unit 301, and transmits the detected actual value to the printer control unit 300 which will be explained later.

The printer control unit 300 controls each operation of the switching unit 303, the actuating motor 302 and the brake unit 301. For example, the printer control unit 300 designates the rotation speed, the rotation direction and the like of the actuating motor 302 and the brake unit 301 in case that the printer control unit 300 instructs each motor to rotate.

In this embodiment, the judgment unit 261 judges the degradation of each surface roughness of the first roller 311 and the belt 313. However, hereinafter, in the explanation relating to the judgment of the degradation, a simple configuration in which the belt 313 is omitted is used. That is, in this explanation, the degradation to be judged is the degradation of the first roller 311 and the degradation of the second roller 312. The first roller 311 and the second roller 312 are pressed against each other, and the brake unit 301 gives the brake force to the second roller 312 and detects the rotation speed of the second roller 312.

When the surface of the first roller 311 and the surface of the second roller 312 which contact with each other are degraded, the adhesion between the first roller 311 and the second roller 312 is decreased because the surface of the first roller 311 and the surface of the second roller 312 become rough. As a result, the first roller 311 and the second roller 312 easily slip. Further, when the first roller 311 and the second roller 312 easily slip, there is a high possibility that the image quality is decreased. Therefore, in case that brake unit 301 applies the brake force having the predetermined strength to the second roller 312 when the first roller 311 is actuated at the predetermined rotation speed in the pressing state in which the first roller 311 and the second roller 312 are pressed against each other by the predetermined pressing force (hereinafter, simply referred to as the brake process judgment time), the judgment unit 261 judges the degradation of the roughness of the portion at which the first roller 311 and the second roller 312 contact with each other, in accordance with the rotation speed of the second roller 312. Further, the changing unit 263 changes the fixing control parameter for the image forming in accordance with the result of the above judgment.

As the degradation progresses, the first roller 311 and the second roller 312 easily slip. Because it is hard to transmit the actuating force from the first roller 311 to the second roller 312, the rotation speed of the second roller 312 in the brake process judgment time is decreased. The judgment unit 261 judges that the degradation of the roughness of the portion at which the first roller 311 and the second roller 312 contact with each other progresses as the rotation speed of the second roller 312 in the brake process judgment time is decreased.

In this embodiment, at the above-described judgment, the rotation speed of the first roller 311 in the brake process judgment time is compared with that of the second roller 312 in the brake process judgment time. As the difference therebetween is large, it is judged that the degradation of the roughness of the portion at which the first roller 311 and the second roller 312 contact with each other progresses. Further, in this embodiment, the rotation speed of the actuating motor 302 is linearly proportional to the rotation speed of the first roller 311, and the actual value of the rotation speed of the motor of the brake unit 301 is linearly proportional to the rotation speed of the second roller 312. The rotation speed of the first roller 311 is calculated from the rotation speed of the actuating motor 302. Further, the rotation speed of the second roller 312 is calculated from the actual value of the rotation speed of the motor of the brake unit 301.

The rotation speed of the first roller 311 and the rotation speed of the second roller 312 correspond to, for example, the lap speed (movement speed) of the periphery of each roller, the rotation speed of the rotation shaft of each roller or the like.

The rotation speed of the actuating motor 302 is the rotation speed which is designated when the printer control unit 300 actuates the actuating motor 302. The actual value of the rotation speed of the motor of the brake unit 301 is detected by the brake unit 301, and the result of the detection of the actual value is transmitted to the printer control unit 300. The judgment unit 261 judges the degradation of the roughness of the portion at which the he first roller 311 and the second roller 312 contact with each other, in accordance with the difference between the rotation speed of the actuating motor 302 and the actual value of the rotation speed of the motor of the brake unit 301, which is obtained by the printer control unit 300. The actual value of the rotation speed of the first roller 311 may be detected.

Further, in this embodiment, the changing unit 263 changes the fixing control parameter for the image forming in accordance with the judgment result obtained by the judgment unit 261. However, the changing unit 263 may change the fixing control parameter in accordance with the number of the rotations of the second roller 312 in the brake process judgment process instead of the judgment result.

The judgment method which is explained above is referred to as the first judgment method. Hereinafter, the judgment method except the first judgment method will be explained.

Next, the second judgment method for judging the degradation more precisely than the above first judgment method will be explained. According to the second judgment method, in the brake process judgment time, the brake force is applied to the second roller 312 so as to change the strength thereof in the multistage manner. Then, the rotation speed of the second roller 312 (the actual value of the rotation speed of the motor of the brake unit 301) in each stage is investigated.

Figure 8:
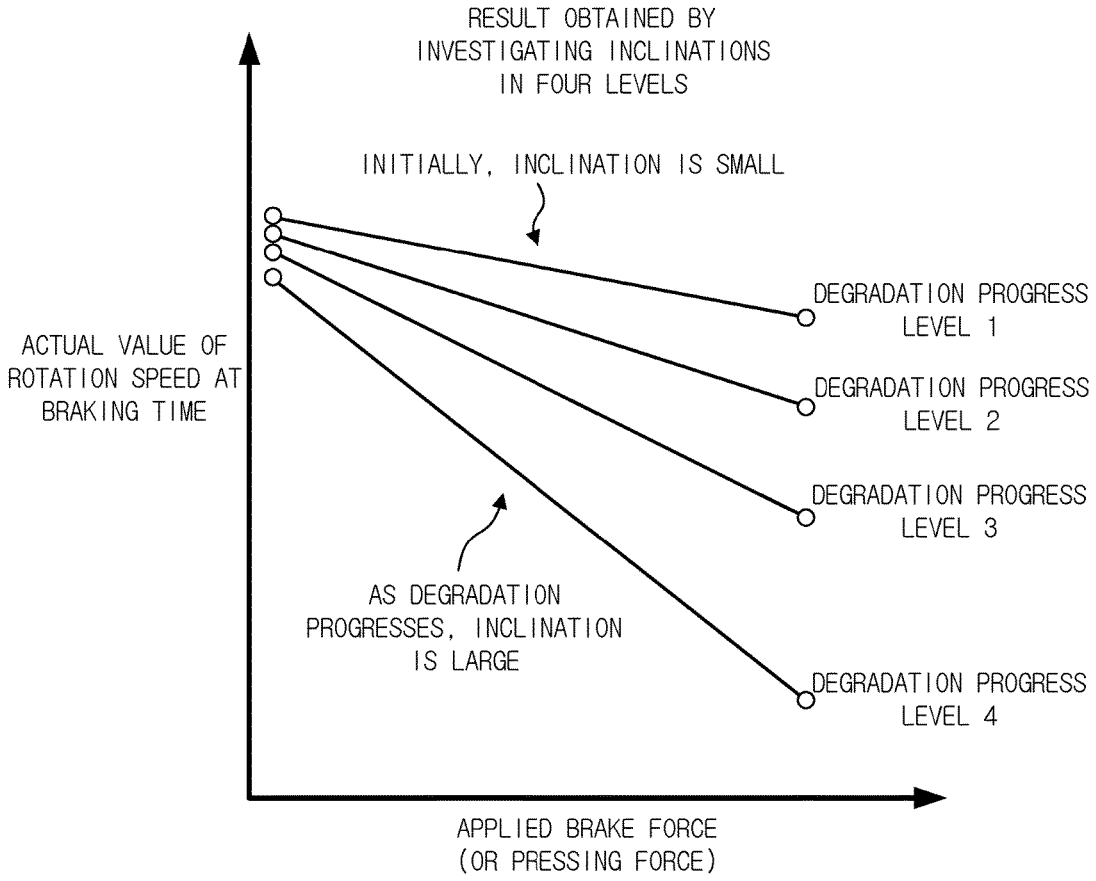
FIG. 8 is a view showing each relation between the strength of the brake force (pressing force) and the rotation speed of the second roller, in four degradation progress levels according to the second embodiment.

FIG. 8 shows the relation between the brake force applied to the second roller 312, that is, the brake force (rotation speed) designated to the motor of the brake unit 301 and the rotation speed of the second roller 312 (the actual value of the rotation speed of the motor of the brake unit 301) in each degradation progress of the first roller 311 and the second roller 312 by using four graphs (degradation progress levels 1 to 4). The degradation progresses in the order of the degradation progress level 1, the degradation progress level 2, the degradation progress level 3 and the degradation progress level 4.

In FIG. 8, as indicated in the four graphs, when the degradation progresses, the difference between the rotation speed of the second roller 312 (the actual value of the rotation speed of the motor of the brake unit 301), which is measured when the brake force is weakly applied and the rotation speed of the second roller 112, which is measured when the brake force is strongly applied, is large. Further, as the degradation progresses, the inclination of the graph becomes large.

Therefore, the judgment unit 261 calculates the change ratio of the actual rotation speed to the brake force in accordance with the change in the rotation speed of the second roller 312 (the actual value of the rotation speed of the motor of the brake unit 301) in each stage in case that the brake force is applied to the second roller 312 so as to change the strength thereof in the multistage manner. As the calculated change ratio is large (as the inclination of the graph is large), the judgment unit 261 judges that the degradation of the roughness of the portion at which the first roller 311 and the second roller 312 contact with each other progresses.

The first judgment method and the second judgment method may be used combinationally. Alternatively, only one of the methods may be used. In the second judgment method, when the brake force is applied so as to change the strength thereof in the multistage manner, the situation in which the brake force is not applied may be set as one stage.

In the second judgment method, instead of the brake force, the pressing force which is applied between the first roller 311 and the second roller 312 may be changed in the multistage manner. In this case, the brake force to be applied in each stage is constant. Also in case that the pressing force is changed in the multistage manner, like the graphs shown in FIG. 8, when the degradation progresses, the difference between the rotation speed of the second roller 312, which is measured when the pressing force is weakly applied and the rotation speed of the second roller 312, which is measured when the pressing force is strongly applied (the change ratio of the actual rotation speed to the pressing force), is large. Further, as the degradation progresses, the inclination of the graph becomes large. In the brake process judgment time, by changing the pressing force between first roller 311 and the second roller 312 in the multistage manner and by comparing the rotation speed of the second roller 312 in one stage with the rotation speed in another stage, the judgment unit 261 judges that the degradation progresses as the above difference (the inclination of the graph) is large.

In this embodiment, the timing at which the judgment unit 261 judges the degradation is the timing at which the temperature sensor unit 251 detects the predetermined temperature in the first warming up (the starting up) of the image forming apparatus 240 every morning. As the predetermined temperature, a plurality of temperatures are set. Whenever the temperature of the fixing member reaches one of the predetermined temperatures, the judgment unit 261 judges the degradation of the fixing member. That is, the judgment unit 261 judges the degradation of the fixing member at a plurality of times in the warming up.

The changing unit 263 changes the fixing control parameter for the image forming in accordance with a plurality of judgment results which are obtained whenever the temperature of the fixing member reaches one of the predetermined temperatures. Specifically, the fixing control parameter is changed in accordance with the average value of the degradation progress indicated in a plurality of results. Alternatively, the fixing control parameter is changed in accordance with the result indicating that the degradation progresses the most among a plurality of results.

The above judgment may be carried out at another timing. For example, the judgment may be carried out when the predetermined time comes, when the images are printed on the predetermined number of recording sheets, or when the instruction for carrying out the judgment is received via the management server 210 or the operating unit 256.

For example, the timing at which the predetermined time period elapses since the previous judgment may be set to the timing at which the next judgment is carried out. For example, in case that the sum of the integrated values obtained by multiplying the brake force applied by the brake unit 301 in the fixing process of the image forming after the previous judgment, by the time period in which the above brake force is applied, exceeds the threshold value, the judgment may be carried out.

Figure 9:
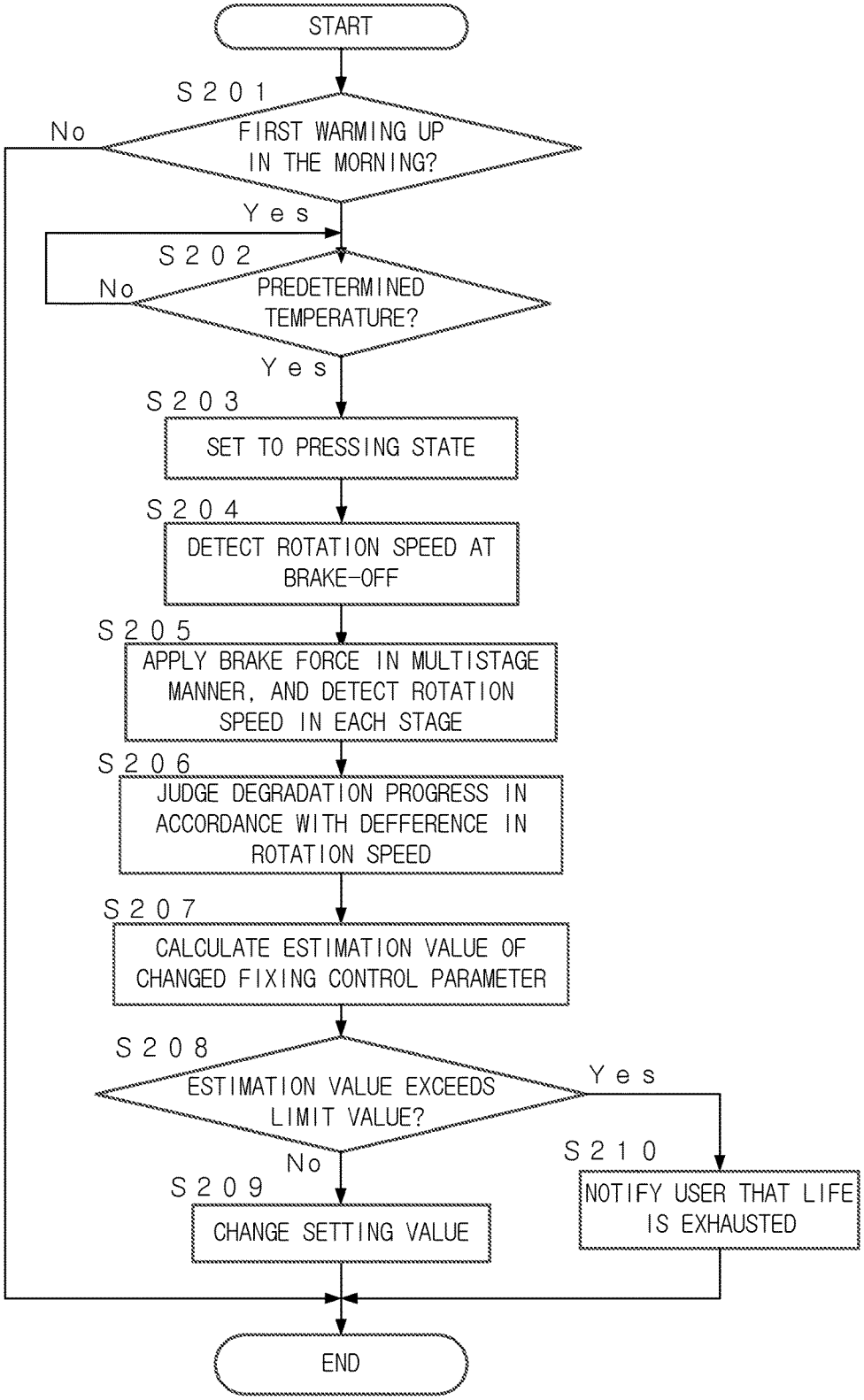
FIG. 9 is a flowchart showing the process for judging the degradation progress of the surface of the fixing member by the image forming apparatus according to the second embodiment.

FIG. 9 shows the process for judging the degradation progress of the roughness of each surface of the first roller 311 and the second roller 312, which is carried out by the image forming apparatus 240. Firstly, in case that the first warming up in a day (the first warming up in the morning) is not currently carried out for the image forming apparatus 240 (Step S201; No), the process is ended. On the other hand, in case that the first warming up in a day is currently carried out for the image forming apparatus 240 (Step S201; Yes), the image forming apparatus 240 waits until the temperature of the fixing place (fixing member) is increased to the predetermined temperature by the warming up, that is, the temperature sensor unit 251 detects the predetermined temperature (Step S202; No). When the temperature sensor unit 251 detects the predetermined temperature (Step S202; Yes), the first roller 311 and the second roller 312 are set to the pressing state by the predetermined pressing force (Step S203).

Next, in the normal state, that is, in the situation in which the brake unit 301 does not apply the brake force, the image forming apparatus 240 actuates the actuating motor 302 (the first roller 311) at the predetermined rotation speed. Then, the image forming apparatus 240 detects the actual value of the rotation speed of the motor of the brake unit 301 (the second roller 312) (Step S204).

Next, the image forming apparatus 240 instructs the brake unit 301 to apply the brake force so as to change the strength thereof in the multistage manner, and actuates the actuating motor 302 (the first roller 311) at the predetermined rotation speed. Then, the image forming apparatus 240 detects the actual value of the rotation speed of the motor of the brake unit 301 (the second roller 312) in each stage (Step S205).

The image forming apparatus 240 judges the degradation progress of the roughness of each surface of the first roller 311 and the second roller 312 in accordance with each rotation speed detected in Step S204 and Step S205 (Step S206). In this case, the image forming apparatus 240 calculates the change ratio of the actual rotation speed of the second roller 312 to the change in the brake force, and judges the degradation progress in accordance with the calculated change ratio.

When the degradation progress is judged in Step S206, the image forming apparatus 240 calculates the estimation value of the changed fixing control parameter according to the degradation progress (Step S207). The calculated estimation value does not exceed the limit value of the fixing control parameter (Step S208; No), the setting value of the fixing control parameter is changed to the calculated estimation value of the changed fixing control parameter (Step S209). Then, the process is ended.

In case that the estimation value of the changed fixing control parameter exceeds the limit value (Step S208; Yes), the image forming apparatus 240 judges that each life of the first roller 311 and the second roller 312 is exhausted, and notifies the user of the above judgment (Step S210). Then, the process is ended.

Although not shown in FIG. 9, in Step S206, the image forming apparatus 240 transmits the judgment result to the management server 210. The management server 210 stores the judgment result received from each image forming apparatus 240, and estimates each lifetime of the units in each image forming apparatus 40 in accordance with the judgment result.

For example, when the fixing device is replaced in each image forming apparatus 240, the management server 210 collects the degradation progress of the fixing device which is judged immediately before the fixing device is replaced and the information indicating the usage condition of the image forming apparatus 240. The collected information indicating the usage condition, includes the information indicating the usage frequency of each type of the recording sheets, the type of the recording sheet to be mainly used, the type of user and the like. Then, in accordance with the collection of the above information from a plurality of image forming apparatuses 240, for example, in accordance with the type of the recording sheet to be mainly used, the management server 210 determines the threshold value of the degradation progress, which is used for judging the replacement timing (the lifetime) of the fixing device. Then, the management server 210 notifies each image forming apparatus 240 of the threshold value which is determined in accordance with the type of the recoding sheet to be mainly used in the image forming apparatus 240, and instructs each image forming apparatus 240 to judge the lifetime of the fixing device by using the threshold value. Alternatively, the management server 210 judges the lifetime of the fixing device of each image forming apparatus 240 in accordance with the usage condition thereof.

Next, the fixing control parameter for the image forming will be explained. FIG. 10 shows an example of the fixing control parameter. In the fixing control parameter, a plurality of items relating to the image forming are registered. In each item, three boxes for entering the setting values of the item are provided.

In this embodiment, the case in which the brake force and the fixing temperature are registered as a plurality of items of the fixing control parameter will be explained. The brake force is a parameter relating to the brake force to be added in the image forming by the brake unit 301. The fixing temperature is a parameter relating to the target temperature to which the fixing lump 305 heats the fixing roller in the image forming.

In each item, as the boxes for entering the setting values of the item, three boxes for entering the level immediately after the replacement, the limit value and the next setting value, are provided. The level immediately after the replacement indicates the setting value of the item in case that the image forming is carried out immediately after the fixing member is replaced with a new one. The limit value indicates the limit value of the setting value of the item. The next setting value indicates the setting value in the next image forming. In the image forming apparatus 240, the value which exceeds (or falls below) the limit value indicated in the limit value box cannot be set.

The limit value of the brake force indicates the maximum value of the setting value which can be set. The fixing temperature has the trade-off relation with the fixation. The limit value of the fixing temperature indicates the minimum temperature which is required to fix the image on the recording sheet in the image forming.

In FIG. 10, with respect to the brake force, Level 4 is registered as the level immediately after the replacement, Level 10 is registered as the limit value and Level 7 is registered as the next setting value. With respect to the fixing temperature, YYY degrees is registered as the level immediately after the replacement, XXX degrees is registered as the limit value and YYY degrees is registered as the next setting value.

Normally, the changing unit 263 changes the next setting value so as to strengthen the brake force or to decrease the fixing temperature as the degradation of the fixing member progresses. As a result, the image quality having a certain level or more is maintained in the next image forming.

In case that each setting value of the fixing control parameter is changed, the setting values of a plurality of items may be combinedly changed. However, in this embodiment, firstly, the setting value of one item is changed. When the changed setting value of one item exceeds the limit value, the changing unit 263 stops changing the setting value of the above one item and then changes the setting value of another item. The setting values are changed in the order of the setting value of the brake force and the setting value of the fixing temperature.

For example, the image forming apparatus 240 previously provides the lookup table in which the degradation level of the fixing member is set as the input value and each value of the fixing control parameter is set as the output value. By referring to the lookup table, the estimation value of each item of the changed fixing control parameter is obtained. Then, the changing unit 263 changes each value of the fixing control parameter in accordance with each estimation value obtained by the lookup table.

In case that the estimation value of one item, which is obtained by the lookup table exceeds the limit value, the changing unit 263 sets the limit value instead of the obtained estimation value. Further, in case that the estimation values of all of the items, which are obtained by the lookup table exceed the limit values, the image forming apparatus 240 judges that the life of the fixing member is exhausted.

Figure 11:
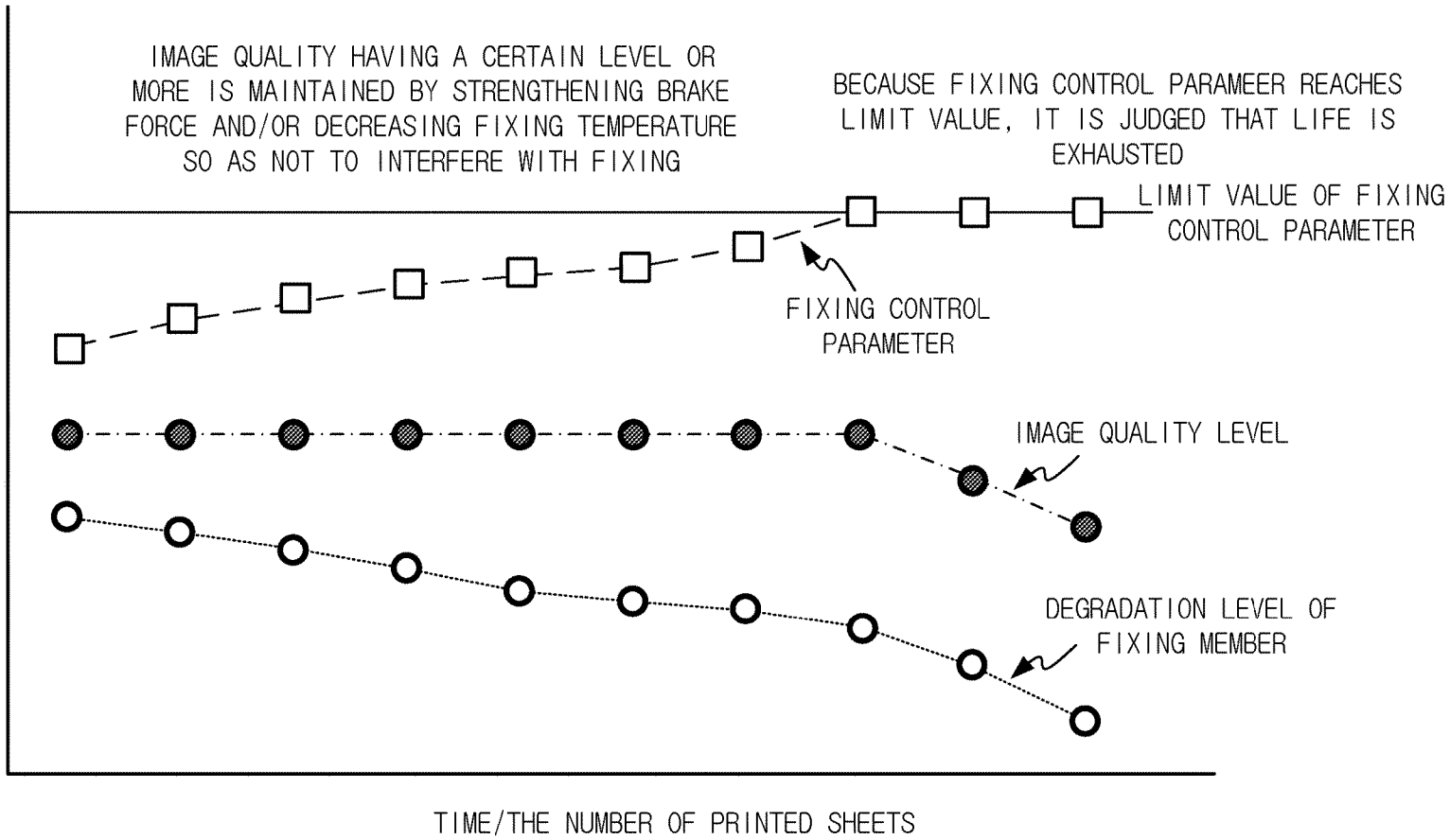
FIG. 11 is a view showing the graphs indicating the relation among the fixing control parameter, the degradation level of the fixing member and the image quality level.

FIG. 11 shows the graphs indicating the relation among the degradation level of the fixing member, the fixing control parameter for the image forming and the image quality level at the printout.

With the lapse of time, or as the total number of the printed recording sheets increases, the fixing member is gradually degraded. According to the degradation progress, the image forming apparatus 240 changes the setting value of each item of the fixing parameter and maintains the image quality level, for example, by strengthening the brake force and/or by decreasing the fixing temperature so as not to interfere with the fixing.

In case that the setting value of each item of the fixing control parameter reaches the limit value, the setting value can be changed no longer according to the degradation progress. As a result, as the degradation progresses, the image quality level is decreased. Therefore, the limit value at which the image quality level can be maintained by changing the fixing control parameter is the threshold value for judging whether the life of the fixing member is exhausted. Alternatively, when the image quality level is decreased to a certain level or less in the situation in which the setting value reaches the limit value, it may be judged that the life of the fixing member is exhausted.

According to this embodiment, when the first roller 311 is actuated by the predetermined actuating force in the pressing state in which the first roller 311 and the second roller 312 are pressed against each other by the pressing force, the image forming apparatus 240 judges the degradation progress of the fixing member in accordance with the rotation speed of the second roller 312 which is measured when the brake unit 301 applies the predetermined brake force to the second roller 312. Then, the image forming apparatus 240 changes the fixing control parameter for the image forming in accordance with the result of the above judgment. Thereby, it is possible to prevent the image quality from being decreased due to the degradation of the fixing member.

Further, in case that the fixing control parameter is not changed, the image quality is directly decreased due to the degradation of the fixing member. However, by changing the fixing control parameter, it is possible to delay the timing at which the image quality is decreased due to the degradation of the fixing member. As a result, in case that the fixing control parameter is changed, it is possible to extend the lifetime of the fixing member as compared with the case in which the fixing control parameter is not changed.

As described above, the embodiments are explained by using the drawings. However, in the present invention, the concrete configuration is not limited to the above embodiments. In the present invention, various modifications of the above embodiments or the addition of various functions or the like to the embodiments can be carried out without departing from the gist of the invention.

In the first embodiment, the image forming apparatus 40 which is the multi function peripheral is explained as an example of the device to be maintained. The device to be maintained is not limited to the image forming apparatus 40, and may be another device for carries out the printing, such as a facsimile device, a printer, a copy machine or the like. The device to be maintained may be a device having the mechanism in which the image is fixed on the recording sheet by sandwiching the recording sheet between a pair of the rollers (or between the roller and the belt) and by pressing the recording sheet.

In the first embodiment, as shown in FIG. 5, in case that the value indicated in the judgment result reaches the predetermined value in Step S107, the image forming apparatus 40 notifies the user that the life of the fixing member is exhausted. However, regardless of whether the value indicated in the above judgment result reaches the predetermined value, the image forming apparatus 40 may notify the user of the judgment result when the judgment is carried out.

In the first embodiment, the fixing device in which the belt 113 is bridged to the second roller 112 is explained. However, the present invention is also applied to the fixing device in which the first roller 111 and the second roller 112 are directly pressed against each other without the belt 113.

In the second embodiment, the image forming apparatus 240 which is the multi function peripheral is explained as an example of the device to be maintained. The device to be maintained is not limited to the image forming apparatus 240, and may be another device for carries out the printing, such as a facsimile device, a printer, a copy machine or the like. The device to be maintained may be a device having the mechanism in which the image is fixed on the recording sheet by sandwiching the recording sheet between a pair of the rollers (or between the roller and the belt) and by pressing the recording sheet.

In the second embodiment, the fixing device in which the belt 313 is bridged to the second roller 312 is explained. However, the present invention is also applied to the fixing device in which the first roller 311 and the second roller 312 are directly pressed against each other without the belt 313.

In the second embodiment, the fixing control parameter for the image forming is changed in accordance with the judgment result obtained in the brake process judgment time. However, in accordance with the value used for the judgment, that is, the rotation speed of the second roller 312 which is detected in the brake process judgment time, the fixing control parameter may be directly changed.

In the second embodiment, as shown in FIG. 10 and FIG. 11, the fixing temperature is decreased according to the degradation of the fixing member. However, according to the type of the recording sheet, the situation and the like, when the fixing temperature is increased, the image quality can be prevented from being decreased. Therefore, the setting value of each item of the fixing control parameter may be changed so as to prevent the image quality from being decreased.

In the second embodiment, in FIG. 10 and FIG. 11, the brake force and the fixing temperature are explained as an example of the items of the fixing control parameter. The item of the fixing control parameter is not limited to these. For example, the pressing force and the like may be included in the fixing control parameter. The pressing force is the force for pressing the first roller 311 against the second roller 312 when the switching unit 303 switches the state of a pair of the first roller 311 and the second roller 312 to the pressing state. For example, in order to prevent the quality from being decreased due to the gloss memory caused by the degradation of the fixing member, the pressing force is weakened.

The limit value of the fixing temperature is inversely proportional to the setting value of the pressing force. As the pressing force is weakened, the limit value of the fixing temperature is increased. In case that the pressing force is weakened in the situation in which the setting value of the fixing temperature has already reached the limit value, in order to secure the fixation, the fixing temperature may be increased so as not to exceed the limit value which is increased according to the changed pressing force.

In at least one of the above embodiments, in accordance with the rotation speed of the second roller which is detected when the first roller is actuated at the predetermined speed in the situation in which the first roller and the second roller are pressed against each other by the predetermined pressing force and when the predetermined brake force is applied to the second roller, the degradation progress of each surface roughness of the first roller and the second roller is judged. The rotation speed of the second roller corresponds to the movement speed of the periphery of the rotated second roller, the rotation speed of the rotation shaft of the second roller or the like.

In at least one of the above embodiments, the second roller comprises a plurality of rollers and a belt which is bridged to each periphery of a plurality of rollers. The actuating force applied to one of the rollers is transmitted to each roller via the belt. Further, when the first roller and the second roller are in the pressing state, one of a plurality of rollers in the second roller and the first roller are pressed against each other so as to sandwich the belt.

In at least one of the above embodiments, the difference between the rotation speed of the second roller, which is detected when the brake force is weakly applied and the rotation speed of the second roller, which is detected when the brake force is strongly applied, becomes large as each surface roughness of the first roller and the second roller is degraded. Therefore, by changing the applied brake force in the multistage manner, the rotation speed of the second roller is detected in each stage. Then, the degradation of each surface roughness of the first roller and the second roller is judged in accordance with the result of the detection of each rotation speed.

In at least one of the above embodiments, the difference between the rotation speed of the second roller, which is detected when the pressing force is weakly applied and the rotation speed of the second roller, which is detected when the pressing force is strongly applied, becomes large as each surface roughness of the first roller and the second roller is degraded. Therefore, by changing the applied pressing force in the multistage manner, the rotation speed of the second roller is detected in each stage. Then, the degradation of each surface roughness of the first roller and the second roller is judged in accordance with the result of the detection of each rotation speed.

In at least one of the above embodiments, the degradation of each surface roughness of the first roller and the second roller is judged at the predetermined timing which is previously set, for example, at the timing of the first warming up every morning, or the like.

In at least one of the above embodiments, when the fixing unit (fixing device) is replaced in each image forming apparatus, the server collects the degradation progress of the fixing unit which is judged immediately before the fixing device is replaced and the information indicating the usage condition of the image forming apparatus. The collected information indicating the usage condition, includes the information indicating the usage frequency of each type of the recording sheets, the type of the recording sheet to be mainly used, the type of user and the like. Then, in accordance with the collection of the above information from a plurality of image forming apparatuses, for example, in accordance with the type of the recording sheet to be mainly used, the server determines the threshold value of the degradation progress, which is used for judging the replacement timing (the lifetime) of the fixing device. Then, the server notifies each image forming apparatus of the threshold value which is determined in accordance with the type of the recoding sheet to be mainly used in the image forming apparatus, and instructs each image forming apparatus to judge the lifetime of the fixing device by using the threshold value. Alternatively, the server judges the lifetime of the fixing device of each image forming apparatus in accordance with the usage condition thereof.

In at least one of the above embodiments, the rotation speed of the second roller is measured when the first roller is actuated at the predetermined speed in the situation in which the first roller and the second roller are pressed against each other by the predetermined pressing force and when the brake force having the predetermined strength is applied to the second roller. Then, the fixing control parameter for the image forming is changed. Thereby, the image quality can be suitably prevented from being decreased due to the degradation of the fixing member. As a result, it is possible to extend the lifetime of the fixing member.

In at least one of the above embodiments, the second roller comprises a plurality of rollers and a belt which is bridged to each periphery of a plurality of rollers. The actuating force applied to one of the rollers is transmitted to each roller via the belt. Further, when the first roller and the second roller are in the pressing state, one of a plurality of rollers in the second roller and the first roller are pressed against each other so as to sandwich the belt.

In at least one of the above embodiments, the difference between the rotation speed of the second roller which is measured when the brake force is weakly applied and the rotation speed of the second roller which is measured when the brake force is strongly applied, becomes large as the degradation of the roughness of each surface of the first roller and the second roller progresses. Therefore, the applied brake force is changed in the multistage manner and the rotation speed of the second roller is measured in each stage. Then, the fixing control parameter is changed in accordance with the result of the measurement of each rotation speed.

In at least one of the above embodiments, the difference between the rotation speed of the second roller which is measured when the pressing force is weakly applied and the rotation speed of the second roller which is measured when the pressing force is strongly applied, becomes large as the degradation of the roughness of each surface of the first roller and the second roller progresses. Therefore, the applied pressing force is changed in the multistage manner and the rotation speed of the second roller is measured in each stage. Then, the fixing control parameter is changed in accordance with the result of the measurement of each rotation speed.

In at least one of the above embodiments, for example, in case that the predetermined temperature is set to X degrees and Y degrees (X<Y), when the first roller is actuated at the predetermined speed in the pressing state in which the first roller and the second roller are pressed against each other by the predetermined pressing force, the rotation speed of the second roller is measured at both of the timing at which the temperature of the fixing place reaches X degrees and the timing at which the temperature of the fixing place reaches Y degrees in the situation in which the brake force having the predetermined strength is applied to the second roller. Then, in accordance with the result of the measurement of the rotation speed which is measured at the above two timings, the fixing control parameter is changed.

The fixing control parameter cannot be set so as to exceed the limit value because the fixation is secured above a certain degree. Therefore, in case that the value of the changed fixing control parameter exceeds the limit value, because the fixing control parameter can be practically set only up to the limit value, the image quality cannot be prevented from being decreased. Therefore, in case that the value of changed fixing control parameter exceeds the limit value, it is judged that each life of the first roller and the second roller is exhausted. Then, the image forming apparatus reports that each life is exhausted.

According to the image forming apparatus and the lifetime judgment system, it is possible to detect the change in the surface condition of the fixing member by using only the usual mechanism. Further, according to the image forming apparatus, it is possible to secure the image quality above a certain degree by using only the usual mechanism even if the surface condition of the fixing member is changed.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus for forming an image on a recording sheet, comprising:

a first roller and a second roller that conveys the recording sheet by sandwiching the recording sheet between the first roller and the second roller in a fixing process of an image forming;

a pressing actuator that presses the first roller and the second roller against each other by a predetermined pressing force;

an actuating motor that actuates the first roller;

a brake that applies a brake force to the second roller;

a rotation speed detector that detects a rotation speed of the second roller; and a hardware processor that judges a degradation of each surface roughness of the first roller and the second roller in accordance with the rotation speed of the second roller, which is detected when the first roller is actuated at a predetermined rotation speed in a situation in which the first roller and the second roller are pressed against each other by the predetermined pressing force and when the brake applies a predetermined brake force to the second roller.

2. The image forming apparatus of claim 1, wherein the second roller comprises a plurality of rollers and a belt which is bridged to the plurality of rollers, and in the situation in which the first roller and the second roller are pressed against each other, one of the plurality of rollers and the first roller are pressed against each other so as to sandwich the belt.

3. The image forming apparatus of claim 1, wherein the brake force applied by the brake is changed in a multistage manner and the rotation speed detector detects the rotation speed of the second roller in each stage; and the hardware processor judges the degradation of the surface roughness in accordance with a change in the rotation speed of the second roller, which is caused by changing the brake force in the multistage manner.

4. The image forming apparatus of claim 1, wherein the pressing force applied by the pressing actuator is changed in a multistage manner and the rotation speed detector detects the rotation speed of the second roller in each stage; and the hardware processor judges the degradation of the surface roughness in accordance with a change in the rotation speed of the second roller, which is caused by changing the pressing force in the multistage manner.

5. The image forming apparatus of claim 1, wherein the hardware processor reports a result of judging the degradation of the surface roughness.

6. The image forming apparatus of claim 5, wherein the hardware processor reports the result when a degradation progress of the surface roughness, which is judged by the hardware processor, exceeds a predetermined threshold value, and the threshold value can be changed by a user.

7. The image forming apparatus of claim 1, wherein the hardware processor judges the degradation at a predetermined timing which is previously set.

8. A lifetime judgment system, comprising:

a server; and a plurality of the image forming apparatuses of claim 1, wherein the server collects information indicating a usage condition of each image forming apparatus and a result of judging the degradation, which is obtained when a fixing unit is replaced, from each of the image forming apparatuses, the server calculates a threshold value of a degradation progress of the surface roughness in each usage condition in accordance with the usage condition and the result of judging the degradation which are collected from each of the image forming apparatuses, the threshold value being used for judging whether a life of the fixing unit is exhausted, and the server judges a lifetime of the fixing unit in each image forming apparatus in accordance with the threshold value calculated in accordance with the usage condition of the image forming apparatus, or the server instructs the image forming apparatus to judge the lifetime of the fixing unit in accordance with the threshold value calculated in accordance with the usage condition of the image forming apparatus.

9. An image forming apparatus for forming an image on a recording sheet, comprising:

a first roller and a second roller that conveys the recording sheet by sandwiching the recording sheet between the first roller and the second roller in a fixing process of an image forming, which is carried out in accordance with a fixing control parameter;

a pressing actuator that presses the first roller and the second roller against each other by a predetermined pressing force;

an actuating motor that actuates the first roller;

a brake that applies a brake force to the second roller;

a rotation speed measurer that measures a rotation speed of the second roller when the first roller is actuated at a predetermined rotation speed in a situation in which the first roller and the second roller are pressed against each other by the predetermined pressing force and when the brake applies a predetermined brake force to the second roller; and a hardware processor that changes the fixing control parameter which is used in the fixing process of the image forming in accordance with the rotation speed of the second roller, which is measured by the rotation speed measurer.

10. The image forming apparatus of claim 9, wherein the second roller comprises a plurality of rollers and a belt which is bridged to the plurality of rollers, and in the situation in which the first roller and the second roller are pressed against each other, one of the plurality of rollers and the first roller are pressed against each other so as to sandwich the belt.

11. The image forming apparatus of claim 9, wherein the brake force applied by the brake is changed in a multistage manner and the rotation speed measurer measures the rotation speed of the second roller in each stage; and the hardware processor changes the fixing control parameter in accordance with a change in the rotation speed of the second roller, which is caused by changing the brake force in the multistage manner.

12. The image forming apparatus of claim 9, wherein the pressing force applied by the pressing actuator is changed in a multistage manner and the rotation speed measurer measures the rotation speed of the second roller in each stage; and the hardware processor changes the fixing control parameter in accordance with a change in the rotation speed of the second roller, which is caused by changing the pressing force in the multistage manner.

13. The image forming apparatus of claim 9, wherein the hardware processor changes the brake force as the fixing control parameter.

14. The image forming apparatus of claim 9, wherein the hardware processor changes a fixing temperature in the fixing process as the fixing control parameter.

15. The image forming apparatus of claim 9, wherein the rotation speed measurer measures the rotation speed of the second roller at a predetermined timing which is previously set.

16. The image forming apparatus of claim 15, further comprising:

a heater that heats a fixing member; and a temperature detector which detects a temperature of the fixing member in the fixing process, wherein the predetermined timing is a timing at which the temperature detector detects a predetermined temperature after the heater starts heating the fixing member.

17. The image forming apparatus of claim 16, wherein the predetermined temperature is set to a plurality of temperatures, the rotation speed measurer measures the rotation speed of the second roller when the temperature of the fixing place reaches one of the plurality of temperatures, and the hardware processor changes the fixing control parameter in accordance with the rotation speeds which are measured when the temperature of the fixing place reaches one of the plurality of temperatures.

18. The image forming apparatus of claim 15, wherein the predetermined timing is a timing at which a predetermined time period elapses since the rotation speed measurer measures the rotation speed of the second roller previously, and the rotation speed measurer changes the predetermined time period in accordance with a sum of integrated values obtained by multiplying the brake force applied in the fixing process of the image forming by a time period in which the brake force is applied.

19. The image forming apparatus of claim 9, the hardware processor reports that each life of the first roller and the second roller is exhausted, when a value of the fixing control parameter which is changed in accordance with the rotation speed of the second roller exceeds the limit value of the fixing control parameter.

* * * * *